US008147626B2

(12) United States Patent
Ishikawa et al.

(10) Patent No.: US 8,147,626 B2
(45) Date of Patent: Apr. 3, 2012

(54) METHOD FOR MANUFACTURING HIGH STRENGTH STEEL PLATE

(75) Inventors: Nobuyuki Ishikawa, Tokyo (JP); Toyohisa Shinmiya, Tokyo (JP); Minoru Suwa, Tokyo (JP); Shigeru Endo, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/053,879

(22) Filed: Mar. 22, 2011

(65) Prior Publication Data

US 2011/0168304 A1 Jul. 14, 2011

Related U.S. Application Data

(60) Division of application No. 11/523,387, filed on Sep. 19, 2006, now Pat. No. 7,935,197, which is a continuation of application No. 10/503,025, filed as application No. PCT/JP03/01102 on Feb. 4, 2003, now abandoned.

(30) Foreign Application Priority Data

| | | |
|---|---|---|
| Feb. 7, 2002 | (JP) | 2002-030300 |
| Apr. 26, 2002 | (JP) | 2002-125819 |
| Apr. 26, 2002 | (JP) | 2002-125820 |
| Apr. 26, 2002 | (JP) | 2002-125942 |

(51) Int. Cl.
*C21D 8/02* (2006.01)

(52) U.S. Cl. ..... 148/654; 148/653; 148/662; 148/663; 148/567

(58) Field of Classification Search ..... 148/654, 148/662, 663, 567, 328, 320, 333–336
See application file for complete search history.

(56) References Cited

U.S. PATENT DOCUMENTS

| | | | |
|---|---|---|---|
| 4,534,805 | A | 8/1985 | Jesseman |
| 5,545,270 | A | 8/1996 | Koo |
| 5,948,183 | A | 9/1999 | Okada |
| 6,224,689 | B1 | 5/2001 | Koo |
| 6,228,183 | B1 | 5/2001 | Bangaru |
| 6,514,359 | B2 | 2/2003 | Kawano |
| 6,666,932 | B2 | 12/2003 | Funakawa |

FOREIGN PATENT DOCUMENTS

| | | |
|---|---|---|
| EP | 0123406 | 10/1984 |
| EP | 733715 | 9/1996 |
| EP | 757113 | 2/1997 |
| JP | 54110119 | 8/1979 |

(Continued)

OTHER PUBLICATIONS

European Search Report dated Apr. 13, 2005, application No. EP03737481.

*Primary Examiner* — Deborah Yee
(74) *Attorney, Agent, or Firm* — RatnerPrestia

(57) ABSTRACT

A high strength steel plate containing 0.02 to 0.08% C, by mass, and has substantially a two phase microstructure of ferrite and bainite. The ferrite contains precipitates having a particle size of 30 nm or smaller grain size. The steel plate has a yield strength of 448 MPa or higher. A method for manufacturing the high strength steel plate which comprises hot rolling, accelerated cooling and reheating. The accelerated cooling is conducted down to a temperature of 300 to 600° C. at a cooling rate of 5° C./s or higher. The reheating is conducted up to a temperature of 550 to 700° C. at a heating rate of 0.5° C./s or higher.

8 Claims, 2 Drawing Sheets

FOREIGN PATENT DOCUMENTS

| | | |
|---|---|---|
| JP | 6160866 | 3/1986 |
| JP | 61165207 | 7/1986 |
| JP | 61227129 | 10/1986 |
| JP | 59575 | 1/1993 |
| JP | 5271766 | 10/1993 |
| JP | 770697 | 3/1995 |
| JP | 7173536 | 7/1995 |
| JP | 7216500 | 8/1995 |
| JP | 200164725 | 3/2001 |
| JP | 2002212674 | 7/2002 |
| JP | 200313138 | 1/2003 |
| WO | 9617964 | 6/1996 |
| WO | 9617965 | 6/1996 |
| WO | 9617966 | 6/1996 |

METHOD FOR MANUFACTURING HIGH STRENGTH STEEL PLATE

CROSS-REFERENCE TO RELATED APPLICATIONS

This application is a Divisional Application of application Ser. No. 11/523,387, filed Sep. 19, 2006, now U.S. Pat. No. 7,935,197 B2 issued May 3, 2011 which is a Continuation Application of application Ser. No. 10/503,025, filed Oct. 7, 2004, now abandoned which is the United States national phase application of International Application No. PCT/JP03/01102, filed Feb. 4, 2003, which claims priority of JP2002-030300, filed Feb. 7, 2002, JP2002-125819, filed Apr. 26, 2002, JP2002-125820, filed Apr. 26, 2002 and JP 2002-125942, filed Apr. 26, 2002, which applications are incorporated herein by reference in their entirety for all purposes.

TECHNICAL FIELD

The present invention relates to a steel plate having excellent resistance to hydrogen-induced cracking (HIC resistance), used for manufacturing a steel pipe or the like, and to a method for manufacturing the same.

BACKGROUND ART

Line pipes used for transporting crude oil or natural gas, containing hydrogen sulfide, are required to have what is called "sour-resistance" including HIC resistance and resistance to stress corrosion crack (SCC resistance), adding to strength, toughness, and weldability. The phenomenon of hydrogen-induced cracking (HIC) of steel is based on a process in which hydrogen ions generated by corrosion reaction are adsorbed on the surface of steel, penetrate into steel as atomic hydrogen, and diffuse and accumulate around non-metallic inclusions such as MnS and hard second phase of steel, thus triggering crack initiation by an increase in internal pressure.

To prevent that type of HIC, JP-A-54-110119, (the term "JP-A" referred herein signifies the "Japanese Patent Laid-Open No."), discloses a method for manufacturing a steel for line pipe having excellent HIC resistance by adding an adequate quantity of Ca and Ce depending on the amount of S to suppress generation of acicular MnS and to produce finely dispersed spherical MnS, giving less stress concentration, and thus suppressing initiation and propagation of crack. JP-A-61-60866 and JP-A-61-165207 disclose steels, having excellent HIC resistance, with suppressed formation of martensite-austenite constituent which acts as an initiation site of crack in center segregation zone, and with suppressed formation of hard phase such as martensite or bainite which acts as a propagation route of crack, through reduction in the amount of elements (C, Mn, P, and the like) having strong segregation tendency, soaking treatment in a slab-heating stage, and accelerated cooling during transformation in a cooling stage after hot rolling. For an X80 grade high strength steel plate having excellent HIC resistance, JP-A-5-9575, JP-A-5-271766, and JP-A-7-173536 disclose a plate manufacturing method of suppressing center segregation by reducing C and Mn content, controlling morphology of inclusions by reducing S content and adding Ca, and compensating decrease in strength caused by the reduced C and Mn content by adding Cr, Ni, and the like and by applying accelerated cooling after hot rolling.

The above-described methods for improving HIC resistance, however, deal mainly with suppression of center segregation. On the other hand, for high strength steel plates of API X65 or higher grade which are often manufactured by accelerated cooling or direct quenching, the near surface region of steel plate where cooling rate is high is hardened more than the middle portion of the plate, thus HIC is generated near the surface of steel. Furthermore, microstructure of those high strength steel plates obtained by accelerated cooling is bainite or acicular ferrite, which is relatively high susceptible to cracking, not only in the near surface region but also in the middle region of the plate. Therefore, even if a countermeasure to HIC due to center segregation is applied, it is difficult for high strength steel plates of API X65 grade or higher to avoid completely the HIC originated from sulfide or oxide inclusions. Consequently, to improve HIC resistance of those high strength steel plates, a countermeasure to HIC due to sulfide or oxide inclusions is necessary.

On the other hand, as for high strength steels having excellent HIC resistance without massive bainite and martensite which are highly susceptible to cracking, JP-A-7-216500 discloses an API X80 grade high strength steel having excellent HIC resistance, which consists of ferrite and bainite. JP-A-61-227129 and JP-A-7-70697 disclose high strength steels whose SCC (SSCC) resistance and HIC resistance are improved by controlling microstructure to a single phase of ferrite and by utilizing carbide precipitation strengthening attained by adding large amount of Mo or Ti.

However, bainite phase in a ferrite-bainite steel consisting of ferrite and bainite described in JP-A-7-216500 has relatively high susceptibility to cracking, which is not so high as that of massive bainite or martensite. Accordingly, contents of S and of Mn are required to be strictly controlled, and Ca treatment is essentially required for improving HIC resistance, thus increasing manufacturing cost. Furthermore, the ferrite phase described in JP-A-61-227129 and JP-A-7-70697 has good ductility to show very low susceptibility to cracking, thus HIC resistance is significantly improved compared with bainite or acicular ferrite. The steel consisting of a single phase of ferrite, however, has low strength. Therefore, the steel described in JP-A-61-227129 contains large amount of C and Mo to precipitate large amount of carbides for increasing strength. In a steel strip described in JP-A-7-70697, the strength is improved by coiling a Ti-added steel strip at a specified temperature to utilize TiC precipitation strengthening. To obtain the ferritic microstructure containing dispersed Mo carbides, as described in JP-A-61-227129, however, it is necessary to apply cold working after quenching and tempering, and further to apply tempering, which raises manufacturing cost. In addition, coarse Mo carbides as large as about 0.1 μm are produced, resulting in small effect for strength increase. As a result, it is necessary to increase the amount of carbides by further addition of C and Mo for attaining desired strength. TiC used in a high strength steel described in JP-A-7-70697 is finer than MoC, and is effective for precipitation strengthening. However, the disclosure gives no countermeasure to growth of the TiC, which is easier to grow depending on precipitation temperature. As a result, precipitation strengthening is not sufficient, and large amount of Ti has to be added. In addition, the steel with addition of large amount of Ti shows significant deterioration of toughness of welding heat-affected zone.

DISCLOSURE OF THE INVENTION

An object of the present invention is to provide a high strength steel plate for line pipe having excellent HIC resistance not only against HIC due to center segregation but also against HIC generated at near surface or around inclusions, at low cost without adding large amount of alloying elements.

To attain the above-described object, the present invention firstly provides a high strength steel plate having yield strength of 448 MPa or higher, containing 0.02 to 0.08% C, by mass, and consisting substantially of a two phase microstructure of ferrite and bainite, wherein the ferrite contains precipitates having particle size of 30 nm or smaller. (No. 1 high strength steel plate)

C content is from 0.02 to 0.08%. Carbon is an element necessary to produce bainite, and an element contributing to strengthening of ferrite by precipitating as carbides. If, however, C content is less than 0.02%, sufficient strength cannot be attained, and if C content exceeds 0.08%, toughness and HIC resistance degrade. To obtain further excellent weldability, it is preferable to specify the Ceq defined by the following formula to 0.28 or less for yield strength of 448 MPa or more, to 0.32 or less for yield strength of 482 MPa or more, and to 0.36 or less for yield strength of 551 MPa or more.

$$Ceq=C+Mn/6+(Cu+Ni)/15+(Cr+Mo+V)/5$$

The above-described ferrite contains fine precipitates having particle size of 30 nm or smaller. Ferrite has excellent toughness and HIC resistance, while, normally low strength to give low hardness. Accordingly, when the steel consists of ferrite and bainite, the large difference in hardness between ferrite and bainite makes the interface therebetween act as an origin of crack and as a route of crack propagation, thus HIC resistance becomes poor. For the above-described high strength steel plate, HIC resistance is improved by reducing the hardness difference between ferrite and bainite to a specific level or below. The hardness difference can be reduced by increasing hardness of ferrite. That is, the hardness difference between ferrite and bainite can be decreased by strengthening the ferrite by finely dispersing precipitates. If, however, particle size of precipitates exceeds 30 nm, the strengthening of ferrite by dispersing precipitates becomes insufficient, failing in reducing the hardness difference between ferrite and bainite, thus the particle size of precipitates is specified to 30 nm or smaller. In addition, to strengthen the ferrite more effectively by adding smaller amount of alloying elements and also to establish excellent HIC resistance, the particle size of precipitates is preferably 10 nm or smaller, and more preferably 5 nm or smaller.

The above-described hardness difference between bainite and ferrite is preferably 70 or smaller in Vickers scale (HV). When this hardness difference is HV 70 or smaller, the interface between ferrite and bainite does not serve to accumulate hydrogen atoms and to propagate crack so that HIC resistance does not deteriorate. The hardness difference is more preferably HV 50 or smaller, and is most preferably HV 35 or smaller.

The above-described bainite preferably has HV 320 or smaller. The bainite is effective to attain high strength. If, however, the hardness of bainite exceeds HV 320, martensite-austenite constituent (MA) tends to be formed inside the bainite, which not only acts as an origin of crack but also promotes crack propagation through the interface between ferrite and bainite, thus HIC resistance degrades. However, when the hardness of bainite is HV 320 or smaller, the MA is not formed. Therefore, the upper limit of the hardness of bainite is preferably specified to HV 320, more preferably to HV 300, and most preferably to HV 280.

The above-described bainite preferably has area percentage of 10 to 80%. The bainite is necessary to attain high strength while securing HIC resistance by being coexistent with ferrite. The two phase microstructure of bainite and ferrite is readily formed in a general steel manufacturing process such as accelerated cooling after hot rolling. If the area percentage of bainite is less than 10%, the effect is not sufficient. On the other hand, the high area percentage of bainite degrades HIC resistance. Consequently, the area percentage of bainite is preferably specified to 80% or smaller, and more preferably to 20 to 60%.

The present invention secondly provides a high strength steel plate having yield strength of 448 MPa or higher, and consisting substantially of a two phase microstructure of ferrite and bainite, wherein the ferrite contains complex carbides containing Ti and Mo and having particle size of 10 nm or smaller. The steel plate consists of 0.02 to 0.08% C, 0.01 to 0.5% Si, 0.5 to 1.8% Mn, 0.01% or less P, 0.002% or less S, 0.05 to 0.5% Mo, 0.005 to 0.04% Ti, and 0.07% or less Al, by mass, and balance of Fe, wherein [C/(Mo+Ti)] as ratio of C content to the sum of Mo and Ti contents by atom percentage is from 0.5 to 3. (No. 2-1 high strength steel plate)

In the above-described steel plate, further high strength increase effect is attained by co-addition of Mo and Ti to finely precipitate complex carbides containing basically Mo and Ti in steel compared with the case of MoC and/or TiC precipitation strengthening. The strong effect for strength increase is attributed to fine precipitates having particle size of 10 nm or smaller.

[C/(Mo+Ti)] is from 0.5 to 3. If the ratio is less than 0.5 or more than 3, either one of the elements is excessive in quantity, which causes degradation of HIC resistance or toughness due to formation of hard microstructure. It is more preferable that [C/(Mo+Ti)] is in a range from 0.7 to 2 because finer precipitates having particle size of 5 nm or smaller are obtained.

It is preferable that the difference in hardness between bainite and ferrite is HV 70 or smaller. The bainite preferably has HV 320 or smaller. The bainite preferably has an area percentage of 10 to 80%.

A part or whole of Mo in the above-described No. 2-1 high strength steel plate may be substituted by W. In this case, [Mo+W/2] is from 0.05 to 0.5%, by mass, and [C/(Mo+W+Ti)] as ratio of C content to the sum of Mo, W, and Ti contents by atom percentage is from 0.5 to 3.0. In the ferrite, complex carbides having particle size of 10 nm or smaller and containing Ti, Mo, and W, or Ti and W precipitate. (No. 2-2 high strength steel plate)

The above-described No. 2-2 high strength steel plate may further contain 0.005 to 0.05% Nb and/or 0.005 to 0.1% V, by mass. [C/(Mo+Ti+Nb+V)] as ratio of C content to the sum of Mo, Ti, Nb, and V contents by atom percentage is from 0.5 to 3. In the ferrite, complex carbides having particle size of 10 nm or smaller and containing Ti, Mo, and Nb and/or V precipitate. (No. 2-3 high strength steel plate)

Ti content is preferably from 0.005 or more to less than 0.02%. [C/(Mo+Ti+Nb+V)] is preferably from 0.7 to 2.

A part or whole of Mo in the above-described No. 2-3 high strength steel plate may be substituted by W. In this case, [Mo+W/2] is from 0.05 to 0.5%, by mass, and [C/(Mo+W+Ti+Nb+V)] as the ratio of C content to the sum of Mo, W, Ti, Nb, and contents by atom percentage is from 0.5 to 3. In the ferrite, complex carbides having particle size of 10 nm or smaller and containing Ti, Mo, W, and Nb and/or V, or Ti, W, and Nb and/or precipitate. (No. 2-4 high strength steel plate)

The high strength steel plates of No. 2-1 through No. 2-4 may further contain at least one element selected from the group consisting of 0.5% or less Cu, 0.5% or less Ni, 0.5% or less Cr, and 0.0005 to 0.005% Ca, by mass.

The present invention thirdly provides a high strength steel plate having yield strength of 448 MPa or higher, and consisting substantially of a two phase microstructure of ferrite and bainite, wherein the ferrite contains complex carbides containing at least two elements selected from the group consisting of Ti, Nb, and V and having particle size of 30 nm or smaller. The steel plate consists essentially of 0.02 to 0.08% C, 0.01 to 0.5% Si, 0.5 to 1.8% Mn, 0.01% or less P, 0.002% or less S, 0.07% or less Al, by mass, further at least one element selected from the group consisting of 0.005 to 0.04% Ti, 0.005 to 0.05% Nb, and 0.005 to 0.1% V, and balance of Fe, wherein [C/(Ti+Nb+V)] as ratio of C content to the sum of Ti; Nb, and V contents by atom percentage is from 0.5 to 3. (No. 3 high strength steel plate)

[C/(Ti+Nb+V)] is preferably from 0.7 to 2.0.

It is preferable that the hardness difference between bainite and ferrite is HV 70 or smaller. The bainite preferably has HV 320 or smaller. The bainite preferably has area percentage of 10 to 80%.

The above-described No. 3 high strength steel plate may further contain at least one element selected from the group consisting of 0.5% or less Cu, 0.5% or less Ni, 0.5% or less Cr, and 0.0005 to 0.005% Ca, by mass.

The present invention also provides a method for manufacturing a high strength steel plate having yield strength of 448 MPa or higher comprising the steps of: hot rolling; accelerated cooling; and reheating.

The step of hot rolling is conducted by heating a steel slab at 1000 to 1300° C. and then hot rolling the slab, and finishing rolling at 750° C. or above. The heating temperature of slab is preferably in a range from 1050 to 1250° C.

The step of accelerated cooling is conducted by accelerated cooling the hot rolled steel plate to the cooling stop temperature of from 300 to 600° C. at a cooling rate of 5° C./s or higher. The cooling stop temperature is preferably in a range from 400 to 600° C.

The step of reheating is conducted by reheating the steel plate immediately after cooling to the temperature of from 550 to 700° C. at a heating rate of 0.5° C./s or higher. The reheating is preferably carried out so as to reheat the steel plate by 50° C. or more above the cooling stop temperature. The step of reheating is preferably given by an induction heating apparatus installed on the same line of rolling mill and accelerated cooling apparatus.

The above-described steel slab may have the compositions of high strength steel plates of No. 2-1 through No. 2-4 and of high strength steel plate of No. 3.

Furthermore, the present invention provides a method for manufacturing a high strength steel plate having yield strength of 448 MPa or higher comprising the steps of: hot rolling; accelerated cooling; and reheating.

The step of hot rolling is conducted by heating a steel slab at 1050 to 1250° C. and then hot rolling the slab, and finishing rolling at 750° C. or above.

The step of accelerated cooling is conducted by accelerated cooling the hot rolled steel plate to the cooling stop temperature of from 300 to 600° C. at a cooling rate of 5° C./s or higher, so as to form a two phase microstructure of untransformed austenite and bainite.

The step of reheating is conducted by reheating the steel plate immediately after cooling to the temperature of from 550 to 700° C. at a heating rate of 0.5° C./s or higher, by 50° C. or more above the cooling stop temperature, so as to form a two phase microstructure of ferrite containing dispersed precipitates and tempered bainite.

The above-described steel slab may have the compositions of high strength steel plates of No. 2-1 through No. 2-4 or of high strength steel plate of No. 3.

EMBODIMENTS OF THE INVENTION

First Embodiment

Figure 1:
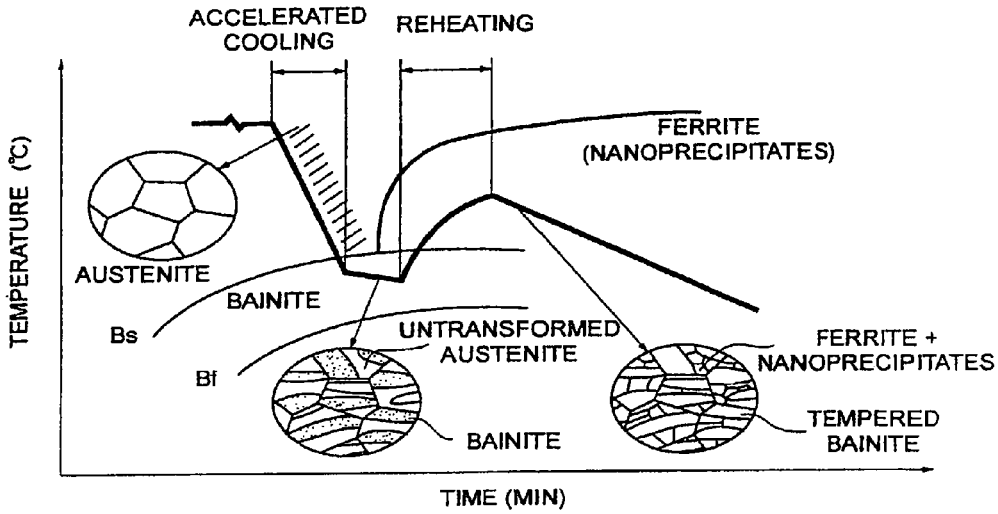
FIG. 1 is a scheme of heat history in a manufacturing method according to the present invention.

To obtain both excellent HIC resistance and high strength, the inventors of the present invention studied microstructure of steel, and found that a two phase microstructure of ferrite and bainite is the most effective. That is, for improving HIC resistance, the ferrite is effective, and for improving strength, the bainite is effective. The two phase microstructure of ferrite and bainite, which is generally used in high strength steels, is a mixed microstructure of soft ferrite and hard bainite. That kind of microstructure tends to accumulate hydrogen atoms at the interface between ferrite and bainite, and the interface acts as a route for propagating crack, thus degrading HIC resistance. The inventors of the present invention, however, found that both high strength and excellent HIC resistance are attained by adjusting the strength of ferrite and that of bainite to control the difference in hardness therebetween to a specific range. Furthermore, the inventors of the present invention acquired findings that the control of hardness of bainite to a specific level or below is effective to suppress initiation of crack from the bainite, and that the utilization of precipitation strengthening with fine precipitates is highly effective to increase strength of the ferrite while securing excellent HIC resistance of the ferrite.

The high strength steel plate having excellent HIC resistance according to the first embodiment is described below in detail. First, the description of microstructure of steel is given in the following.

The microstructure of steel according to the first embodiment is made of a two phase microstructure consisting substantially of ferrite and bainite. The ferrite has high ductility and extremely low susceptibility to cracking, and thus improves HIC resistance. Since the bainite has excellent strength and toughness, both excellent HIC resistance and high strength are attained by forming a two phase microstructure of ferrite and bainite. Other than ferrite and bainite, if other phases such as martensite or pearlite are mixed in steel, HIC likely occurs due to accumulation of hydrogen and stress concentration at the interface between different phases. Accordingly, smaller percentage of other phases than ferrite and bainite are more preferable. However, when the volume percentage of other phases than ferrite and bainite is small, the influence of the other phases can be neglected. Consequently, one or more of other phases such as martensite, pearlite, or cementite may exist at a volume percentage of 5% or smaller.

The area percentage of bainite is preferably from 10 to 80%. The bainite is necessary to attain high strength while securing HIC resistance by forming a two phase microstructure with ferrite. The two phase microstructure is readily formed through a general treatment such as accelerated cooling after hot rolling in a steel manufacturing process. If the area percentage of bainite is less than 10%, the effect is not sufficient. On the other hand, when the area percentage is higher than 80% of bainite, HIC resistance degrades. Consequently, the area percentage of bainite is preferably specified to 80% or smaller, and more preferably from 20 to 60%.

Regarding the steel plate according to the first embodiment, ferrite should contain fine precipitates having particle size of 30 nm or smaller which are dispersed therein. Since ferrite has high ductility, it has excellent HIC resistance. Ferrite, however, normally has low strength to give low hardness. Accordingly, when the two phase microstructure consisting of ferrite and bainite is formed, the difference in hardness between ferrite and bainite becomes large, and the interface therebetween acts as an origin of crack and a route for crack propagation, thus HIC resistance becomes poor. According to the first embodiment, HIC resistance is improved by controlling the hardness difference between ferrite and bainite to a specific value or below, that is, by increasing the hardness of ferrite due to dispersion of fine precipitates. If, however, the particle size of precipitates exceeds 30 nm, the strengthening of ferrite by dispersed precipitates becomes insufficient to fail in reducing the hardness difference between ferrite and bainite to HV 70 or smaller. Therefore, the particle size of precipitates should be specified to 30 nm or smaller. The number of precipitates having particle size of 30 nm or smaller is preferably 95% or more to all the precipitates except for TiN. In addition, to strengthen the ferrite more effectively by adding smaller amount of alloying elements and also to establish excellent HIC resistance, the size of precipitates is preferably 10 nm or smaller. Since the above-described complex carbides are extremely fine, it does not give influence on HIC resistance.

The precipitates which are finely dispersed in ferrite may be any kind if only the precipitates strengthen ferrite without degrading HIC resistance. Since, carbides, nitrides, or carbonitrides containing one or more of Mo, Ti, Nb, V, and the like can readily be finely precipitated in ferrite by an ordinary steel manufacturing method, use of them is preferred. To generate fine precipitates dispersing in ferrite, a method for generating them on the transformation interface formed by ferrite transformation from overcooled austenite is applicable.

Since the strength of steel depends on the kind, the size, and the number of precipitates, the strength can be controlled by the kind and content of alloying elements. If higher strength is required, it is preferable to increase content of carbide-forming elements such as Mo, Ti, Nb, and V, and as a result to increase number of precipitates. To obtain a high strength steel plate having yield strength of 448 MPa or higher, the number of precipitates is preferably $2\times10^3$ per $\mu m^3$.

The precipitation behavior is not specifically limited, and it may be random or raw precipitation.

When precipitates finely dispersed in ferrite are complex carbides containing Mo and Ti, extremely high strength is attained. Mo and Ti are carbide former elements in steel. The strengthening of steel by the precipitation of MoC and TiC is applied in the related art. However, by combined addition of Mo and Ti to steel to finely precipitate complex carbides containing basically Mo and Ti, the effect of strength improvement is stronger than the case of MoC or TiC single precipitation strengthening.

This strong effect of strength improvement is based on the fact that the complex carbides containing basically Mo and Ti are stable and grow slowly so that extremely fine precipitates having particle size smaller than 10 nm are obtained.

If higher toughness of weldment is required, a part of Ti may be substituted by other elements (such as Nb and V) to improve toughness of weldment without degrading effect of strength increase.

The difference in hardness between ferrite and bainite according to the first embodiment is preferably HV 70 or smaller. As described before, the interface between different phases, or between ferrite and bainite, acts as a site for accumulating hydrogen atoms which cause HIC and acts as a route of crack propagation, which results in degradation of HIC resistance. If, however, the difference in hardness between ferrite and bainite is HV 70 or smaller, the interface therebetween does not act as a site for accumulating hydrogen atoms and a route for crack propagation, thus HIC resistance does not degrade. Preferably the hardness difference therebetween is HV 50 or smaller, and more preferably HV 35 or smaller. The hardness is measured by a Vickers hardness tester. Although hardness tester can select arbitrary load to obtain optimum dent size in the respective phases, it is preferred to measure the hardness with the same load for both ferrite and bainite. For example, a Vickers hardness tester applying 50 g of measuring load is applicable for hardness measurements of both phases. Furthermore, considering the dispersion of hardness values caused by the differences in local components of microstructure and in fine structure, or the like, it is preferred to conduct hardness measurement at different places, at least 30 places, for each phase, and to adopt the average hardness for each phase as hardness of ferrite and of bainite. The difference in hardness measured by the average hardness is the absolute value of difference between the average value of, hardness of ferrite and the average value of hardness of bainite.

In the steel plate according to the first embodiment, the hardness of bainite is preferably HV 320 or smaller. The bainite is effective to attain high strength. If, however, the hardness of bainite exceeds HV 320, formation of martensite-austenite constituent (MA) is likely formed inside the bainite, and the MA not only acts as an origin of HIC but also allows easy crack propagation at the interface between ferrite and bainite, thus HIC resistance degrades. However, if the hardness of bainite is HV 320 or smaller, the MA is not formed. Therefore, the upper limit of hardness of bainite is preferably specified to HV 320. Since the bainite can be formed by rapid cooling of austenite, the hardness of bainite can be controlled to HV 320 or smaller by adjusting the cooling-stop temperature to a specified temperature or above to suppress the formation of hard phase such as martensite, or by applying a manufacturing method of softening the phase using reheating treatment after cooling. The hardness of bainite is more preferably HV 300 or smaller, and most preferably HV 280 or smaller.

The chemical composition of the steel plate according to the first embodiment is described below. The unit expressed by % applied in the following description is mass percentage.

Carbon: C content is from 0.02 to 0.08%. Carbon is an element necessary to form bainite, and an element of precipitating as carbides to contribute to strengthening of ferrite. If, however, C content is less than 0.02%, sufficient strength cannot be attained, and, if C content exceeds 0.08%, toughness and HIC resistance degrade. Therefore, C content is specified to a range from 0.02 to 0.08%.

The steel plate according to the first embodiment has both excellent HIC resistance and high strength by forming a two phase microstructure and controlling the hardness difference therein. To attain the performance, any kind of alloying elements, other than C may be included in the steel plate. To obtain excellent toughness and weldability, adding to excellent HIC resistance and high strength, one or more of alloying elements, other than C, may be added within the composition range described below.

Silicon: Si content is preferably in a range from 0.01 to 0.5%. Silicon is added for deoxidation. If, however, Si content is less than 0.01%, deoxidation is insufficient, and, if Si content exceeds 0.5%, toughness and weldability degrade. Consequently, it is preferable that Si content, if added, is specified to a range from 0.01 to 0.5%.

Manganese: Mn content is preferably in a range from 0.1 to 2%. Manganese is added to increase strength and toughness. If, however, Mn content is less than 0.1%, the effect is not sufficient, and, if Mn content exceeds 2%, weldability and HIC resistance degrade. Thus, it is preferable that Mn content, if added, is specified to a range from 0.1 to 2%.

Phosphorus: P content is preferably 0.02% or less. Phosphorus is an inevitable impurity element that degrades toughness, weldability, or HIC resistance. Therefore, it is preferable that the upper limit of P content is specified to 0.02%.

Sulfur: S content is preferably 0.005% or less. Smaller content of S is preferred because S generally forms MnS inclusion in steel to degrade HIC resistance. If, however, S content is 0.005% or less, no problem is induced. Consequently, it is preferable that the upper limit of S content is specified to 0.005%.

Molybdenum: Mo content is preferably 1% or less. Molybdenum is an element effective to enhance bainite transformation, and is an element extremely effective to decrease the difference in hardness between ferrite and bainite by forming carbides in ferrite to harden ferrite. If, however, Mo content exceeds 1%, Mo forms a hard phase such as martensite to degrade HIC resistance. Therefore, it is preferable that Mo content, if added, is specified to 1% or less.

Niobium: Nb content is preferably 0.1% or less. Niobium is an element effective to improve toughness by refining structure, and to harden ferrite by forming carbides in ferrite, thus to decrease the difference in hardness between ferrite and bainite. If, however, Nb content exceeds 0.1%, toughness of welding heat-affected zone degrades. Consequently, it is preferable that Nb content, if added, is specified to 0.1% or less.

Vanadium: V content is preferably 0.2% or less. Similar to Nb, V contributes to increase in strength and toughness. If, however, V content exceeds 0.2%, toughness of welding heat-affected zone degrades. Consequently, it is preferable that V content, if added, is specified to 0.2% or less.

Titanium: Ti content is preferably 0.1% or less. Similar to Nb, Ti contributes to increase in strength and toughness. If, however, Ti content exceeds 0.1%, toughness of welding heat-affected zone degrades, and further Ti causes surface defect during hot rolling. Therefore, it is preferable that Ti content, if added, is specified to 0.1% or less.

Aluminum: Al content is preferably 0.1% or less. Aluminum is added as a deoxidant. If, however, Al content exceeds 0.1%, cleanliness of steel degrades, and HIC resistance degrades. Consequently, it is preferable that Al content, if added, is specified to 0.1% or less.

Calcium: Ca content is preferably 0.005% or less. Although Ca is an element effective to improve HIC resistance by controlling configuration of sulfide inclusion, addition of Ca over 0.005% saturates the effect, and rather degrades HIC resistance due to degradation of steel cleanliness. Therefore, it is preferable that Ca content, if added, is specified to 0.005% or less.

Other than the elements described above, 0.5% or less Cu, 0.5% or less Ni, 0.5% or less Cr, and other elements may be added in steel to increase strength and toughness thereof.

From the viewpoint of weldability, it is preferable to specify the upper limit of Ceq which is defined by the following formula depending on desired strength level. Favorable weldability is attained by specifying the Ceq to 0.28 or smaller for the case of 448 MPa or higher yield strength, 0.32 or smaller for 482 MPa or higher yield strength, and 0.36 or smaller for 551 MPa or higher yield strength.

$$Ceq=C+Mn/6+(Cu+Ni)/15+(Cr+Mo+V)/5$$

Regarding the steel plate according to the first embodiment, there is no dependency of Ceq on plate thickness within a range from 10 to 30 mm in plate thickness. Thus, the design is applicable with the same Ceq value up to 30 mm in plate thickness.

For precipitating complex carbides containing Mo and Ti, and Nb and/or V, in which a part of Ti is substituted by Nb and V, the steel may contain, for example, 0.02 to 0.08% C, 0.01 to 0.5% Si, 0.5 to 1.8% Mn, 0.01% or less P, 0.002% or less S, 0.05 to 0.5% Mo, 0.005 to 0.04% Ti, and 0.07% or less Al, and 0.005 to 0.05% Nb and/or 0.005 to 0.1% V, by mass, and balance of substantially Fe; and having [C/(Mo+Ti+Nb+V)] as ratio of C content to the sum of Mo, Ti, Nb, and V contents by atom percentage from 0.5 to 3. The steel may further contain at least one element selected from the group consisting of 0.5% or less Cu, 0.5% or less Ni, 0.5% or less Cr, and 0.0005 to 0.005% Ca.

The steel plate having a two phase microstructure of ferrite and bainite and containing finely dispersed precipitates in ferrite can be manufactured by using, for example, the steel having the above-described composition, and by applying ordinary rolling process followed by rapid cooling using an accelerated cooling apparatus or the like to temperature of from 400 to 600° C. at a cooling rate of 2° C./s or higher, and further by reheating using an induction heating apparatus or the like to temperature of from 550 to 700° C., followed by air cooling. Alternatively, the steel plate may be manufactured by rapid cooling the hot rolled steel plate to the temperature of from 550 to 700° C., by holding the temperature within 10 min, then by rapid cooling the steel plate to the temperature of 350° C. or above, followed by air cooling.

The steel plate according to the first embodiment may be formed to steel pipes by press-bend forming, roll forming, UOE forming, and the like, and can be utilized in steel pipes (electro-resistance-weld steel pipe, spiral steel pipe, UOE steel pipe) and the like for transporting crude oil and natural gas.

Example

Using the steels (Steel Nos. A to G) having chemical compositions shown in Table 1, the steel plates (Steel plate Nos. 1 to 11) having thickness of 19 mm were manufactured under the conditions given in Table 2.

TABLE 1

| Steel No. | C | Si | Mn | P | S | Mo | Nb | V | Ti | Al | Cu | Ni | Ca | Ceq |
|---|---|---|---|---|---|---|---|---|---|---|---|---|---|---|
| A | 0.046 | 0.26 | 1.70 | 0.013 | 0.0004 | 0.27 | 0.046 | 0.032 | 0.009 | 0.029 | | | | 0.39 |
| B | 0.049 | 0.15 | 1.26 | 0.010 | 0.0012 | 0.10 | 0.040 | 0.048 | 0.023 | 0.036 | | | | 0.29 |
| C | 0.039 | 0.32 | 1.42 | 0.013 | 0.0031 | 0.21 | 0.010 | | 0.046 | 0.020 | | | | 0.32 |
| D | 0.025 | 0.28 | 1.03 | 0.008 | 0.0014 | | 0.035 | 0.042 | 0.009 | 0.043 | | | 0.0026 | 0.21 |
| E | 0.047 | 0.20 | 1.23 | 0.006 | 0.0006 | | | 0.052 | 0.012 | 0.031 | 0.28 | 0.31 | 0.0048 | 0.3 |

TABLE 1-continued

| Steel No. | C | Si | Mn | P | S | Mo | Nb | V | Ti | Al | Cu | Ni | Ca | Ceq |
|---|---|---|---|---|---|---|---|---|---|---|---|---|---|---|
| F | 0.013 | 0.34 | 1.56 | 0.009 | 0.0009 | 0.21 | 0.013 | 0.053 | 0.023 | 0.024 | | | | 0.33 |
| G | 0.094 | 0.24 | 1.68 | 0.014 | 0.0014 | | 0.021 | 0.044 | 0.013 | 0.033 | | | | 0.38 |

*Underline designates outside the range of the present invention.

TABLE 2

| Steel plate No. | Steel No. | Manufacturing method | Micro-structure | Area percentage of bainite (%) | Hardness of ferrite (HV) | Hardness of bainite (HV) | Difference In hardness (HV) |
|---|---|---|---|---|---|---|---|
| 1 | A | Ended hot-rolling at 870° C. → Cooled to 500° C. → Reheated to 650° C. → Air-cooled | F + B | 61 | 248 | 281 | 33 |
| 2 | B | Ended hot-rolling at 870° C. → cooled to 500° C. → Reheated to 650° C. → Air-cooled | F + B | 45 | 231 | 273 | 42 |
| 3 | B | Ended hot-rolling at 900° C. → Cooled to 650° C. → Held at 620° C. for 3 min → Quenched to 500° C. → Air-cooled | F + B | 18 | 226 | 294 | 68 |
| 4 | C | Ended hot-rolling at 870° C. → Cooled to 500° C. → Reheated to 650° C. → Air-cooled | F + B | 65 | 262 | 285 | 23 |
| 5 | D | Ended hot-rolling at 920° C. → Cooled to 420° C. → Reheated to 580° C. followed by holding the temperature for 4 min → Air-cooled | F + B | 75 | 226 | 255 | 29 |
| 6 | E | Ended hot-rolling at 900° C. → Cooled to 500° C. → Reheated to 620° C. → Air-cooled | F + B | 34 | 208 | 248 | 40 |
| 7 | A | Ended hot-rolling at 700° C. → cooled to 410° C. → Air-cooled | F + B | 22 | 195 | 338 | 143 |
| 8 | B | Ended hot-rolling at 920° C. → Cooled to room temperature → Tempered at 550° C. | B | 100 | — | — | — |
| 9 | E | Ended hot-rolling at 900° C. → Cooled to 220° C. → Air-cooled | B | 100 | — | — | — |
| 10 | F | Ended hot-rolling at 900° C. → Cooled to 220° C. → Air-cooled | F + B | 12 | 203 | 325 | 122 |
| 11 | G | Ended hot-rolling at 950° C. → Cooled to room temperature | M | — | — | — | — |

| Steel plate No. | Precipitate in ferrite | Size of precipitate (nm) | Yield strength (MPa) | Tensile strength (MPa) | HIC resistance, CLR (%) | Remark |
|---|---|---|---|---|---|---|
| 1 | (Mo,Ti,Nb,V)C | 4 | 685 | 754 | 0 | Example |
| 2 | (Mo,Ti,Nb,V)C | 3 | 641 | 718 | 0 | |
| 3 | (Mo,Ti,Nb,V)C | 4 | 595 | 680 | 0 | |
| 4 | (Mo,Ti,Nb)C | 5 | 725 | 783 | 0 | |
| 5 | (Ti,Nb,V)C | 16 | 602 | 695 | 0 | |
| 6 | (Ti,V)C | 25 | 567 | 652 | 0 | |
| 7 | (Ti,Nb)C | 68 | 534 | 632 | 72 | Comparative example |
| 8 | — | — | 583 | 648 | 34 | |
| 9 | — | — | 632 | 725 | 25 | |
| 10 | None | — | 526 | 617 | 58 | |
| 11 | — | — | 719 | 836 | 84 | |

* Underline designates outside the range of the present invention.
Microstructure F + B: ferrite + bainite, B: bainite, M: martensite Steel plates Nos. 1 to 6 are the examples according to the first embodiment. They were subjected to, after hot rolling, cooling to specific temperature using an accelerated cooling apparatus, and further to reheating or holding thereof to constant temperature using an induction heating apparatus. The steel plate No. 5, however, was subjected to heat treatment using a gas furnace after cooling. Steel plates Nos. 7 to 11 are comparative examples, which were prepared by applying accelerated cooling after hot rolling, and some of them were further subjected to tempering.

Microstructure of the steel plates was observed using an optical microscope and a transmission electron microscope (TEM). In addition, area percentage of bainite was determined. Hardness of ferrite and of bainite was measured by a Vickers hardness tester with a load of 50 g to determine the difference in hardness between ferrite and bainite by averaging the hardness values obtained on each 30 points. Composition of precipitates in ferrite was analyzed by energy dispersive X-ray spectroscopy (EDX). Average particle size of precipitates in each steel plate was determined. Then, tensile properties and HIC resistance for each steel plate were measured. The results are also given in Table 2. Regarding the tensile properties, tensile test was conducted using a full-thickness test specimen taken in the direction lateral to rolling direction to determine yield strength and tensile strength. As for HIC resistance, HIC test was carried out following NACE Standard TM-02-84 with immersion time of 96 hours to determine crack length ratio (CLR).

Figure 4:
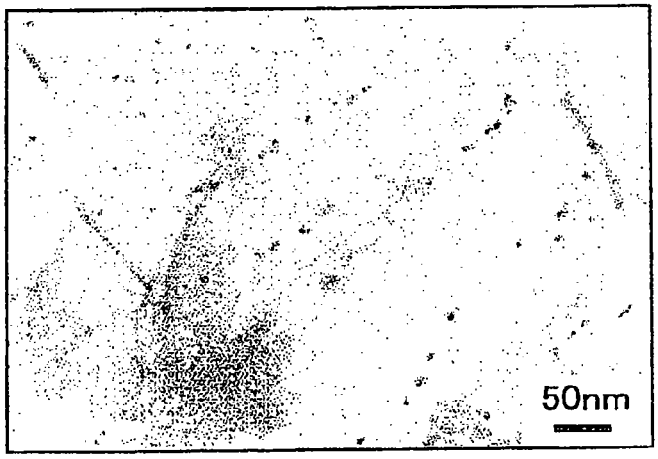
FIG. 4 is an example of microstructure of high strength steel plate according to the present invention.

As shown in Table 2, all the steel plates Nos. 1 to 6 have substantially a two phase microstructure of ferrite and bainite, difference in hardness between ferrite and bainite of HV 70 or smaller, yield strength of 480 MPa or higher and tensile strength of 560 MPa or higher, which are above the strength level of API X65 grade, and giving excellent HIC resistance. FIG. 4 is an example of microstructure of the above-described steel plates, showing many fine precipitates of (Mo, Ti, Nb, V)C dispersed in rows. The steel plates Nos. 1 to 4 have ferrite containing dispersed fine carbides, having particle size of 10 nm or smaller, containing Mo, Ti, Nb, and V, or Mo, Ti, and Nb. The steel plates Nos. 5 and 6 have ferrite containing dispersed fine carbides, having particle size of 30 nm or smaller, containing Ti, Nb, and V, or Ti and V. Hardness of bainite is HV 300 or smaller for all the steel plates.

The steel plates Nos. 7 and 10 have a two phase microstructure of ferrite and bainite. However, hardness of bainite exceeded HV 320, and the difference in hardness between two phases also exceeded HV 70, thus HIC test initiates cracks. The steel plates Nos. 8 and 9 have a single phase microstructure of bainite, and HIC test initiates cracks. The steel plate No. 11 has C content above the range of the first embodiment and martensitic microstructure, thus HIC test initiates cracks.

Using the steel plates Nos. 1, 3, and 7, the steel pipes Nos. 12 to 15 having outer diameter of 762 mm and 660 mm were prepared by UOE process. For each steel pipe, tensile test and HIC test were to determine yield strength, tensile strength, and HIC resistance (crack length ratio (CLR). The results are given in Table 3.

TABLE 3

| Steel pipe No. | Steel plate No. | Steel pipe size (mm) Pipe wall thickness | Steel pipe size (mm) Outer diameter | Yield strength (MPa) | Tensile strength (MPa) | HIC resistance CLR (%) | Remark |
|---|---|---|---|---|---|---|---|
| 12 | 1 | 19 | 762 | 673 | 761 | 0 | Example |
| 13 | 1 | 19 | 660 | 669 | 748 | 0 | |
| 14 | 3 | 19 | 660 | 576 | 685 | 0 | |
| 15 | 7 | 19 | 660 | 548 | 646 | 86 | Comparative example |

The steel pipes Nos. 12 to 14 which were prepared from the steel plates according to the first embodiment have high strength and excellent HIC resistance. To the contrary, the steel pipe No. 15 which was prepared from the steel plate No. 7 as a comparative example initiates cracks during HIC test. After forming these pipes, observation of microstructure and hardness measurement were given, and it was confirmed that these pipes had the same microstructure and equivalent hardness with those of the steel plates (given in Table 2) before pipe forming.

Second Embodiment

To obtain both excellent HIC resistance and high strength, the inventors of the present invention studied in detail microstructure of steel and method for manufacturing thereof, and found that it is the most effective to form a two phase microstructure of ferrite and bainite for attaining both high strength and excellent HIC resistance, and to reduce the difference in strength between ferrite and bainite, and that manufacturing process including accelerated cooling after hot rolling followed by reheating induces strengthening of ferrite which was a soft phase by fine precipitates containing Ti, Mo, and the like, and the softening of bainite which was a hard phase, thus obtaining the two phase microstructure with small difference in strength therebetween. It was concretely found that desired microstructure is obtained firstly by accelerated cooling the steel plate after hot rolling to form a two phase microstructure of untransformed austenite and bainite, and then by reheating it to form ferrite containing dispersed fine precipitates and tempered bainite. Also the inventors of the present invention found that the optimization of amount of Mo and Ti to that of C allows the precipitation strengthening by carbides to maximize. Furthermore, the inventors of the present invention found that co-addition of Nb and/or V achieves the increase in strength of ferrite by dispersed precipitates containing Ti, Mo, and Nb and/or V, and that precipitation strengthening by the carbides is maximized through the optimization of amount of Mo, Ti, Nb, and V to that of C.

The present invention relates to the above-described high strength steel plate for line pipe and the method for manufacturing thereof, having a two phase microstructure of ferrite containing dispersed precipitates containing Ti, Mo, and the like, and bainite, and giving excellent HIC resistance. The steel plate thus manufactured shows no increase in hardness in the surface region thereof as seen in a steel plate having bainite or acicular ferrite, which is manufactured by conventional accelerated cooling or the like, thus no HIC occurs at the surface. Furthermore, since the two phase microstructure giving small difference in strength therebetween shows extremely high resistance to crack initiation, HIC occurring at the center of steel plate and around inclusions can be suppressed.

The microstructure of high strength steel plate for line pipe according to the second embodiment is described below.

The microstructure of steel plate according to the second embodiment is substantially a two phase microstructure of ferrite and bainite. Since the ferrite shows high ductility and gives low susceptibility to cracking, high HIC resistance is attained. The bainite has excellent strength and toughness. The two phase microstructure of ferrite and bainite is generally a mixed microstructure of soft ferrite and hard bainite. The steel plate having that type of microstructure likely induces accumulation of hydrogen atoms at the interface between ferrite and bainite, and the interface therebetween likely acts as a route of crack propagation, thus HIC resistance is poor. According to the second embodiment, however, both excellent HIC resistance and high strength are attained by adjusting the strength of two phases so as to reduce the difference in strength between ferrite and bainite. If one or more kind of other phases such as martensite and pearlite is mixed in the two phase microstructure of ferrite and bainite, HIC likely occurs due to accumulation of hydrogen and stress concentration at the interface between different phases. Accordingly, smaller percentage of other phases than ferrite and bainite is more preferable. However, if volume percentage of other phase than ferrite and bainite is small, the influence of the other phase can be neglected. Consequently, one or more of other phases such as martensite and pearlite may exist at a volume percentage of 5% or smaller. The percentage of bainite is preferably 10% or more from the point of toughness, and preferably 80% or smaller from the point of HIC resistance, and more preferably 20 to 60%.

The precipitates dispersed in ferrite according to the second embodiment will be explained in the following.

In the steel plate according to the second embodiment, ferrite is strengthened by dispersed precipitates containing basically Mo and Ti decreasing the difference in strength between ferrite and bainite, thus excellent HIC resistance is attained. Since the precipitates are extremely fine, they do not give influence on HIC resistance. Mo and Ti are the elements of forming carbides in steel, and the strengthening by precipitating MoC and TiC is applied in the related art. The second embodiment is, however, characterized in that the stronger effect of strength increase is attained by fine precipitates of complex carbides containing basically Mo and Ti compared with the conventional strength increase by single carbides such as MoC and/or TiC. The novel stronger effect of strength increase is attained because carbides containing basically Mo and Ti are stable and slowly grow so that extremely fine precipitates having particle size of 10 nm or smaller are obtained.

Regarding complex carbides containing basically Mo and Ti, when the carbides are made only by Mo, Ti, and C, the combination is given at around 1:1 atom ratio of the C content to the sum of Mo and Ti contents, which is very effective for strength increase. In the second embodiment, the inventors of the present invention found that addition of Nb and/or V also produces complex carbides containing Mo, Ti, and Nb and/or V, which allows the similar precipitation strengthening.

If toughness of welding heat-affected zone is required, a part of Ti may be substituted by Nb and/or V to improve toughness of welding heat-affected zone without degrading effect of strength increase.

For a high strength steel plate having yield strength of 448 MPa or higher, the number of precipitates having particle size of 10 nm or smaller is preferably $2\times10^3$ or more per $\mu m^3$. For the case that the steel contains other precipitates than complex carbides consisting essentially of Mo and Ti, the quantity of the other precipitates should be adjusted to a degree that these precipitates degrade neither effect of strength increase nor improvement of HIC resistance. In that case, the number of precipitates having particle size of 10 nm or smaller is preferably 95% or more to the number of total precipitates except for TiN.

The complex carbides consisting essentially of Mo and Ti, which are dispersed in the steel plate according to the second embodiment, can be dispersed in ferrite by applying the manufacturing method according to the second embodiment to the steel having the composition described below.

In the second embodiment, similar to the first embodiment, the difference in hardness between ferrite and bainite is preferably HV 70 or smaller. When the difference in hardness is HV 70 or smaller, the interface therebetween acts neither as a site for accumulating hydrogen atoms nor as a route for crack propagation, thus HIC resistance does not degrade. The difference in hardness is more preferably HV 50 or smaller, and most preferably HV 35 or smaller.

According to the second embodiment, the bainite preferably has HV 320 or smaller. The bainite is effective to attain high strength. If, however, the hardness of bainite exceeds HV 320, martensite-austenite constituent (MA) is likely formed inside the bainite, which MA not only acts as an origin of crack but also allows easy crack propagation at the interface between ferrite and bainite, thus HIC resistance degrades. However, if the hardness of bainite is HV 320 or smaller, MA is not formed. Therefore, the upper limit of hardness of bainite is preferably specified to HV 320. The hardness of bainite is more preferably HV 300 or smaller, and most preferably HV 280 or smaller.

The chemical composition of steel plate for line pipe according to the second embodiment is described below. The unit expressed by % applied in the following description is mass percentage unless otherwise noted.

Carbon: C content is from 0.02 to 0.08%. Carbon is an element of precipitating as carbides to contribute to precipitate strengthening. If, however, C content is less than 0.02%, sufficient strength cannot be attained, and, if C content exceeds 0.08%, toughness and HIC resistance degrade. Therefore, C content is specified to a range of from 0.02 to 0.08%.

Silicon: Si content is from 0.01 to 0.5%. Silicon is added for deoxidation. If, however, Si content is less than 0.01%, the effect of deoxidation is insufficient, and, if Si content exceeds 0.5%, toughness and weldability degrade. Consequently, Si content is specified to a range from 0.01 to 0.5%.

Manganese: Mn content is from 0.5 to 1.8%. Manganese is added to increase strength and toughness. If, however, Mn content is less than 0.5%, the effect is not sufficient, and, if Mn content exceeds 1.8%, weldability and HIC resistance degrade. Thus, Mn content is specified to a range from 0.5 to 1.8%, and preferably from 0.5 to 1.5%.

Phosphorus: P content is 0.01% or less. Phosphorus is an inevitable impurity element that degrades weldability and HIC resistance. Therefore, the upper limit of P content is specified to 0.01%.

Sulfur: S content is 0.002% or less. Smaller content of S is preferred because S generally forms MnS inclusions in steel to degrade HIC resistance. If, however, S content is 0.002% or less, no problem is induced. Consequently, the upper limit of S content is specified to 0.002%.

Molybdenum: Mo content is from 0.05 to 0.5%. Molybdenum is an important element in the second embodiment. Addition of Mo to 0.05% or more induces formation of fine complex precipitates with Ti while suppressing pearlite transformation during cooling stage after hot rolling, thus significantly contributing to strength increase. If, however, Mo content exceeds 0.5%, Mo forms a hard phase such as martensite to degrade HIC resistance. Therefore, Mo content is specified to a range from 0.05 to 0.50%, and preferably from 0.05% or more to less than 0.3%.

Figure 2:
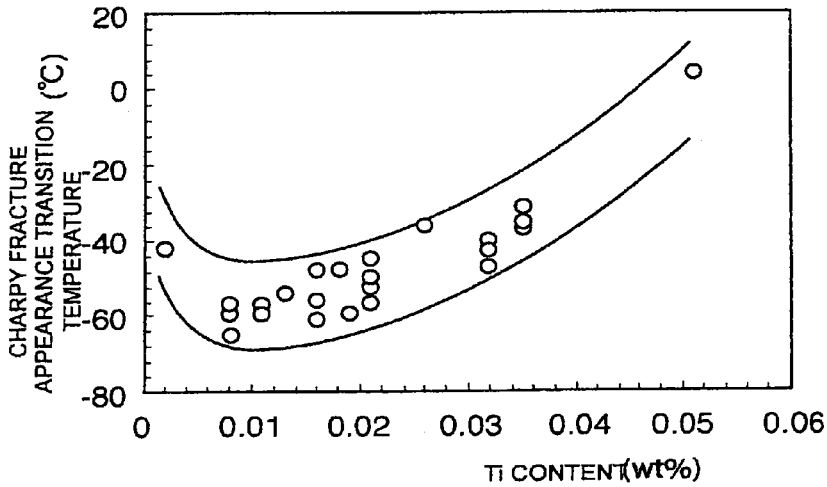
FIG. 2 is a graph showing the relation between Ti content and Charpy fracture appearance transition temperature.

Titanium: Ti content is from 0.005 to 0.04%. Similar to Mo, Ti is an important element in the second embodiment. Addition of Ti to 0.005% or more allows to form complex precipitates with Mo to significantly contribute to strength increase. If, however, as shown in FIG. 2, Ti content exceeds 0.04%, Charpy fracture appearance transition temperature of welding heat-affected zone becomes above −20° C. to degrade toughness. Therefore, Ti content is specified to a range from 0.0055 to 0.04%. When Ti content becomes to less than 0.02%, Charpy fracture appearance transition temperature becomes below −40° C. to provide excellent toughness. Therefore, if Nb and/or V is added to steel, it is more preferable that Ti content is specified to a range from 0.005% or more to less than 0.02%.

Aluminum: Al content is 0.07% or less. Aluminum is added as deoxidant. If, however, Al content exceeds 0.07%, cleanliness of steel degrades, and HIC resistance degrades. Consequently, Al content is specified to 0.07% or less, and preferably from 0.001 to 0.07%.

[C/(Mo+Ti)] as ratio of C content to the sum of Mo and Ti contents is from 0.5 to 3. High strength attained in the second embodiment owes to precipitates (mainly carbides) containing Ti and Mo. To effectively utilize precipitation strengthening by complex precipitates, the relation between C content and contents of Mo and Ti which are elements for forming carbides is important. By adding these elements at an adequate balance, thermally stable and extremely fine complex precipitates are formed. If [C/(Mo+Ti)] is less than 0.5 or more than 3, any one of the elements is in excessive amount, thus inducing formation of hardened structure to degrade HIC resistance and toughness. Consequently, [C/(Mo+Ti)] is specified to a range from 0.5 to 3. The symbol of each element designates the content thereof expressed by atom percentage. If the content expressed by mass percentage is applied, [(C/12.0)/(Mo/95.9+Ti/47.9)] is specified to a range from 0.5 to 3. If the value of [C/(Mo+Ti)] is in a range from 0.7 to 2, further fine precipitates having particle size of 5 nm or smaller are obtained, which is more preferable.

According to the second embodiment, one or both of Nb and V, described below, may be added to further improve strength and toughness of welding zone of steel plate.

Niobium: Nb content is 0.005 to 0.05%. Niobium improves toughness by refining structure. Niobium forms complex precipitates together with Ti and Mo to contribute to strength increase of ferrite. If, however, Nb content is below 0.005%, the effect cannot be attained, and, if Nb content exceeds 0.05%, toughness of welding heat-affected zone degrades. Consequently, Nb content is specified to a range from 0.005 to 0.05%.

Vanadium: V content is from 0.005 to 0.1%. Similar to Nb, V forms complex precipitates together with Ti and Mo to contribute to strength increase of ferrite. If, however, V content is below 0.005%, the effect cannot be attained, and, if V content exceeds 0.1%, toughness of welding heat-affected zone degrades. Consequently, V content is specified to a range from 0.005 to 0.1%, and preferably from 0.005 to 0.05%.

When Nb and/or V is added, [C/(Mo+Ti+Nb+V)] as ratio of C content to the sum of Mo, Ti, Nb, and V contents is from 0.5 to 3.0. High strength attained in the second embodiment owes to precipitates containing Ti and Mo. If, however, Nb and/or V is added, precipitates are complex precipitates (mainly carbides) containing those elements. In that case, if [C/(Mo+Ti+Nb+V)] is less than 0.5 or more than 3, any one of the elements is in excessive amount, thus inducing formation of hardened structure to degrade HIC resistance and toughness. Consequently, [C/(Mo+Ti+Nb+V)] is specified to a range from 0.5 to 3. The symbol of each element designates the content thereof expressed by atom percentage. If content expressed by mass percentage is applied, [(C/12.0)/(Mo/95.9+Ti/47.9+Nb/92.9+V/50.9)] is specified to a range from 0.5 to 3, and more preferably the value thereof is from 0.7 to 2 to provide further fine precipitates having particle size of 5 nm or smaller.

According to the second embodiment, one or more of the following-described Cu, Ni, Cr, and Ca may be added to steel for further improving strength and HIC resistance.

Copper: The Cu content is 0.5% or less. Copper is an element effective to improve toughness and increase strength. Excessive addition, of Cu, however, degrades weldability. Consequently, the upper limit of Cu content, if added, is specified to 0.5%.

Nickel: Ni content is 0.5% or less. Nickel is an element effective to improve toughness and increase strength. Excessive addition of Ni, however, degrades weldability. Consequently, the upper limit of Ni content, if added, is specified to 0.5%.

Chromium: Cr content is 0.5% or less. Similar to Mn, Cr is an element effective to attain sufficient strength even at low C content. Excessive addition of Cr, however, degrades weldability. Consequently, the upper limit of Cr content, if added, is specified to 0.5%.

Calcium: Ca content is from 0.0005 to 0.005%. Although Ca is an element effective to improve HIC resistance by controlling configuration of sulfide inclusions, addition of Ca below 0.0005% cannot attain sufficient effect, and addition of Ca over 0.005% saturates the effect, and rather degrades HIC resistance by degradation of steel cleanliness. Therefore, Ca content, if added, is specified to a range from 0.0005 to 0.005%.

From the viewpoint of weldability, it is preferable to specify the upper limit of the Ceq which is defined by the following-formula depending on desired strength level. Favorable weldability is attained by specifying the Ceq to 0.28 or smaller for the case of 448 MPa or higher yield strength, 0.32 or smaller for 482 MPa or higher yield strength, and 0.36 or smaller for 551 MPa or higher yield strength.

$$Ceq=C+Mn/6+(Cu+Ni)/15+(Cr+Mo+V)/5$$

Regarding the steel plate according to the second embodiment, there is no dependency of Ceq on plate thickness within a range from 10 to 30 mm in plate thickness. Thus, the design is applicable with the same Ceq value up to 30 mm in plate thickness.

Other than the above-described elements, balance is substantially Fe. The term "balance is substantially Fe" means that the steel containing inevitable impurities and other trace elements is within the scope of the second embodiment unless the effect is, hindered.

Method for manufacturing a high strength steel sheet for line pipe according to the second embodiment will be explained in the following.

FIG. 1 shows a scheme of the method for controlling microstructure according to the second embodiment. By applying accelerated cooling to a steel from austenite at or above Ar3 point to bainite, a mixed microstructure of untransformed austenite and bainite is formed. By reheating the steel immediately after cooling, the austenite is transformed to the ferrite, and dispersed fine precipitates are generated in the ferrite. On the other hand, the bainite is tempered. By forming a two phase microstructure having ferrite which is precipitation strengthened by fine precipitates and bainite which is tempered and softened, both high strength and excellent HIC resistance are obtained. The method for controlling microstructure will be described in detail in the following.

The high strength steel sheet for line pipe according to the second embodiment can be manufactured in the following process. A steel having the above-described composition is hot rolled at the finishing temperature of 750° C. or higher after heated at the temperature of 1000 to 1300° C. Then, the hot rolled steel plate is cooled to the temperature of 300 to 600° C. at a cooling rate of 5° C./s or higher. Immediately after the cooling, the steel plate is reheated to the temperature of 550 to 700° C. at a heating rate of 0.5° C./s or higher to precipitate fine complex carbides mainly formed by Mo and Ti dispersed in ferrite, and to obtain softened bainite. The temperature given above is average temperature of steel plate.

Heating temperature: Heating temperature is from 1000 to 1300° C. If heating temperature is below 1000° C., formation of solid solution of carbide is insufficient, which fails in attaining desired strength. If heating temperature exceeds 1300° C., toughness degrades. Therefore, heating temperature is specified to a range from 1000 to 1300° C., and preferably from 1050 to 1250° C.

Finishing temperature: Finishing temperature is 750° C. or above. If finishing temperature is low, microstructure is elongated in the rolling direction, which not only degrades HIC resistance but also decreases ferrite transformation rate to increase reheating time after rolling, which is not preferable from the point of manufacturing efficiency. Therefore, finishing temperature is specified to 750° C. or above.

Immediately after rolling, the steel plate is cooled at a cooling rate of 5° C./s or higher. If the steel is air cooled after rolling, or if the steel is slowly cooled after rolling, precipitates are produced at high temperature, and thus the precipitates readily become coarse to fail in strengthening ferrite. Accordingly, applying rapid cooling (accelerated cooling) to the cooling stop temperature optimum for precipitation strengthening is an important manufacturing condition in the second embodiment. If cooling rate is below 5° C./s, the effect of preventing precipitation at high temperature is insufficient and strength decreases. Therefore, cooling rate after rolling is specified to 5° C./s or more. Accelerated cooling may be conducted using arbitrary cooling apparatus depending on manufacturing process.

Cooling stop temperature: Cooling stop temperature is from 300 to 600° C. By accelerated cooling after rolling, the steel plate is rapidly cooled to the cooling stop temperature of 300 to 600° C., which is bainite transformation zone, thus bainite is formed and driving force of ferrite transformation during reheating is increased. The increased driving force enhances ferrite transformation during reheating, and the ferrite transformation can be finished in a short time. If the cooling stop temperature is below 300° C., microstructure becomes a single phase of bainite or martensite, or even when a two phase microstructure of ferrite and bainite is formed, martensite-austenite constituent (MA) appears, both of which degrade HIC resistance. If the cooling stop temperature exceeds 600° C., ferrite transformation in reheating stage is not complete, and pearlite is formed, which degrades HIC resistance. Therefore, the cooling stop temperature in accelerated cooling is specified to a range from 300 to 600° C. To surely suppress MA formation, the cooling stop temperature is preferably regulated to 400° C. or above.

Immediately after accelerated cooling, the steel plate is reheated to the temperature of 550 to 700° C. at a heating rate of 0.5° C./s or higher. This process is an important manufacturing step of the second embodiment. Fine precipitates contributing to strengthening of ferrite is generated at the same time when ferrite transformation occurs during reheating. To strengthen ferrite by fine precipitates and at the same time to soften bainite so as to obtain a two phase microstructure having small difference in strength between ferrite and bainite, it is necessary to apply reheating, immediately after accelerated cooling, to the temperature of from 550 to 700° C. On reheating, it is preferable that temperature rise is at least 50° C. above the above cooling stop temperature. If the heating rate during reheating is less than 0.5° C./s, long time is required to reach target temperature, which degrades manufacturing efficiency and which also induces pearlite transformation. Thus, dispersed fine precipitates cannot be obtained, and sufficient strength cannot be attained. If the reheating temperature is below 550° C., ferrite transformation cannot be completed, and untransformed austenite transforms to pearlite during succeeding cooling stage, thus HIC resistance degrades. If the reheating temperature exceeds 700° C., precipitates become coarse to fail in attaining sufficient strength. Consequently, the reheating temperature is specified to a range from 550 to 700° C. At the reheating temperature, there is no need of specifying holding time. By the manufacturing method according to the second embodiment, even immediate cooling after reheating allows ferrite transformation to sufficiently proceed to attain high strength by fine precipitates. To surely complete ferrite transformation, holding at the reheating temperature within 30 min. may be adopted. However, if the holding time exceeds 30 min., coarse precipitates may be formed and decrease strength. Cooling rate after reheating may be arbitrarily selected. Since, however, ferrite transformation proceeds even in cooling stage after reheating, air cooling is preferred. Nevertheless, cooling at a higher rate than that of air cooling may be applied if it does not give no influence on ferrite transformation.

An apparatus for reheating a steel plate to the temperature of 550 to 700° C. may be installed next to accelerated cooling apparatus. Preferable heating apparatus includes a gas furnace or an induction heating apparatus, which can apply rapid heating to steel plate. Induction heating apparatus is specifically preferred because it can easily control temperature compared with soaking furnace and the like, is relatively inexpensive, and further is able to rapidly heat cooled steel plate. In addition, direct and successive arrangement of multiple induction heating apparatuses can arbitrarily select heating rate and reheating temperature for various conditions of line speed, and kind and size of steel plate only by selecting the number of induction heating apparatuses. Since cooling rate after reheating is arbitrary, there is no need of installing special apparatus next to the reheating apparatus.

Figure 3:
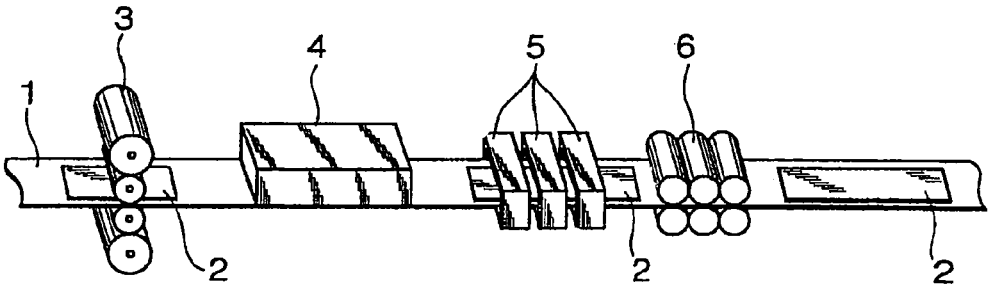
FIG. 3 is a scheme illustrating an example of manufacturing line for carrying out the manufacturing method according to the present invention.

FIG. 3 is a schematic drawing illustrating an example of manufacturing line for carrying out the manufacturing method according to the second embodiment. As shown in FIG. 3, rolling line 1 has, from upstream to downstream, hot rolling mill 3, accelerated cooling apparatus 4, in-line induction heating apparatus 5, and a hot leveler 6. Since the in-line induction heating apparatus 5 or other heat treatment apparatus is installed in the same line as the hot rolling mill 3 and the accelerated cooling apparatus 4, reheating treatment can be given promptly after hot rolling and accelerated cooling. As a result, steel plate after hot rolling and accelerated cooling can immediately be reheated to 550° C., or above.

The steel plate according to the second embodiment, which is manufactured by the above-described method, may be formed to steel pipes using press-bend forming, roll forming, UOE forming, and the like, and can be utilized in steel pipes (electro-resistance-weld steel pipe, spiral steel pipe, UOE steel pipe) and the like for transporting crude oil and natural gas. The steel pipes manufactured from the steel plate according to the second embodiment are suitable also for transportation of crude oil and natural gas, containing hydrogen sulfide, owing to its high strength and excellent HIC resistance.

Example

The steels (steel. Nos. A to N) having the chemical compositions shown in Table 4 were continuously cast to slabs. Using the slabs, the steel plates (Nos. 1 to 26) having 18 and 26 mm in thickness were prepared.

TABLE 4

(mass %)

| Steel No. | C | Si | Mn | P | S | Mo | Ti | Al | Nb | V | Cu | Ni | Cr | Ca | C/(Mo + Ti + Nb + V) | Ceq | Remark |
|---|---|---|---|---|---|---|---|---|---|---|---|---|---|---|---|---|---|
| A | 0.049 | 0.22 | 1.38 | 0.009 | 0.0012 | 0.19 | 0.032 | 0.032 | | | | | | | 1.54 | 0.32 | Chemical |
| B | 0.075 | 0.25 | 1.28 | 0.005 | 0.0011 | 0.21 | 0.014 | 0.046 | 0.014 | | | | | | 2.37 | 0.33 | composition |
| C | 0.065 | 0.26 | 1.54 | 0.008 | 0.0009 | 0.42 | 0.024 | 0.026 | 0.019 | | | | | | 1.06 | 0.41 | within |
| D | 0.052 | 0.18 | 1.24 | 0.010 | 0.0006 | 0.21 | 0.015 | 0.036 | 0.022 | 0.025 | | | | | 1.29 | 0.31 | the range |
| E | 0.049 | 0.14 | 1.20 | 0.002 | 0.0008 | 0.11 | 0.012 | 0.032 | 0.042 | 0.047 | | | | 0.0019 | 1.47 | 0.28 | of the |
| F | 0.048 | 0.19 | 1.25 | 0.007 | 0.0006 | 0.10 | 0.022 | 0.031 | 0.039 | 0.051 | | | | 0.0022 | 1.37 | 0.29 | invention |
| G | 0.052 | 0.22 | 1.25 | 0.008 | 0.0009 | 0.24 | 0.018 | 0.031 | 0.030 | 0.015 | 0.14 | 0.22 | | 0.0009 | 1.24 | 0.33 | |
| H | 0.025 | 0.09 | 1.06 | 0.005 | 0.0013 | 0.05 | 0.008 | 0.025 | 0.016 | 0.031 | | | 0.18 | 0.0032 | 1.42 | 0.22 | |
| I | 0.051 | 0.22 | 1.51 | 0.006 | 0.0011 | 0.06 | 0.002 | 0.037 | 0.012 | | | | | | 5.33 | 0.31 | Chemical |
| J | 0.045 | 0.19 | 1.65 | 0.010 | 0.0009 | 0.01 | 0.021 | 0.026 | 0.045 | 0.042 | | | | | 2.02 | 0.33 | composition |
| K | 0.053 | 0.20 | 1.98 | 0.005 | 0.0008 | 0.15 | 0.035 | 0.028 | 0.037 | 0.041 | | | | 0.0025 | 1.26 | 0.42 | outside |
| L | 0.012 | 0.22 | 1.35 | 0.004 | 0.0008 | 0.24 | 0.011 | 0.031 | 0.018 | | | 0.11 | 0.15 | | 0.34 | 0.32 | the range |
| M | 0.098 | 0.11 | 1.45 | 0.009 | 0.0009 | 0.21 | 0.023 | 0.029 | 0.039 | 0.110 | | | | 0.0068 | 1.55 | 0.40 | of the |
| N | 0.048 | 0.19 | 1.25 | 0.007 | 0.0029 | 0.24 | 0.015 | 0.036 | 0.071 | 0.041 | 0.20 | 0.26 | | 0.0018 | 0.93 | 0.34 | invention |

* Underline designates outside the range of the present invention.

The steel plates, prepared by heating the slabs and hot rolling them, were immediately cooled by an accelerated cooling apparatus of water cooling type, and then were reheated by an induction heating furnace or a gas furnace. Both the accelerated cooling apparatus and the induction heating furnace were installed in the same line. The manufacturing conditions of the steel plates (Nos. 1 to 26) are given in Table 5.

Microstructure of thus prepared steel plates was observed using a optical microscope and a transmission electron microscope (TEM). In addition, area percentage of bainite was determined. Hardness of ferrite and of bainite was measured by a Vickers hardness tester with a load of 50 g to determine the difference in hardness between ferrite and bainite by averaging the values obtained from 30 points of measurement. Composition of precipitates in ferrite was analyzed by energy dispersive X-ray spectroscopy (EDX). Tensile properties and HIC resistance for each steel plate were measured. The results of measurements are also given in Table 5. Regarding tensile properties, tensile test was conducted using a full-thickness specimen taken in the direction lateral to rolling direction to determine yield strength and tensile strength. Considering dispersion during manufacturing, the steel plate having yield strength of 480 MPa or higher and tensile strength of 580 MPa or higher was estimated as a high strength steel plate of API X65 or higher grade, (the specification: yield strength≧448 MPa and tensile strength≧530 MPa). As for HIC resistance, HIC test was given conforming to NACE Standard TM-02-84 with an immersion time of 96 hours, and the steel plate giving no crack was judged to have good HIC resistance and marked with ○, and the steel plate giving crack initiation was marked with x.

TABLE 5

| Steel plate No. | Steel No. | Plate thickness (mm) | Heating temperature (° C.) | Finishing temperature (° C.) | Cooling rate (° C./s) | Cooling stop temperature (° C.) | Reheating apparatus |
|---|---|---|---|---|---|---|---|
| 1 | A | 18 | 1200 | 850 | 37 | 480 | Induction heating furnace |
| 2 | B | 18 | 1200 | 780 | 34 | 410 | Induction heating furnace |
| 3 | C | 26 | 1200 | 920 | 26 | 510 | Induction heating furnace |
| 4 | D | 26 | 1100 | 800 | 24 | 500 | Induction heating furnace |
| 5 | E | 18 | 1200 | 850 | 31 | 490 | Induction heating furnace |
| 6 | E | 18 | 1200 | 790 | 30 | 500 | Induction heating furnace |
| 7 | E | 18 | 1200 | 820 | 32 | 420 | Induction heating furnace |
| 8 | E | 18 | 1200 | 860 | 35 | 480 | Gas-fired furnace |
| 9 | F | 26 | 1200 | 850 | 38 | 540 | Induction heating furnace |
| 10 | F | 26 | 1100 | 840 | 35 | 510 | Induction heating furnace |
| 11 | G | 18 | 1200 | 880 | 34 | 570 | Gas-fired furnace |
| 12 | G | 18 | 1200 | 850 | 48 | 465 | Induction heating furnace |
| 13 | H | 18 | 1200 | 900 | 42 | 510 | Gas-fired furnace |
| 14 | D | 18 | 950 | 800 | 33 | 500 | Induction heating furnace |
| 15 | D | 18 | 1150 | 720 | 32 | 520 | Induction heating furnace |
| 16 | D | 18 | 1200 | 850 | 2 | 495 | Induction heating furnace |

TABLE 5-continued

| | | | | | | | |
|---|---|---|---|---|---|---|---|
| 17 | D | 18 | 1200 | 840 | 38 | 320 | Induction heating furnace |
| 18 | D | 26 | 1200 | 850 | 25 | 450 | Gas-fired furnace |
| 19 | D | 26 | 1200 | 850 | 21 | 450 | Induction heating furnace |
| 20 | D | 26 | 1200 | 850 | 23 | 400 | Induction heating furnace |
| 21 | I | 18 | 1200 | 820 | 45 | 490 | Induction heating furnace |
| 22 | J | 18 | 1200 | 820 | 32 | 550 | Induction heating furnace |
| 23 | K | 18 | 1200 | 820 | 38 | 450 | Gas-fired furnace |
| 24 | L | 26 | 1200 | 860 | 26 | 510 | Induction heating furnace |
| 25 | M | 26 | 1200 | 860 | 19 | 480 | Gas-fired furnace |
| 26 | N | 26 | 1200 | 860 | 20 | 510 | Gas-fired furnace |

| Steel plate No. | Reheating rate (°/s) | Reheating temperature (° C.) | Micro-structure | Yield strength (MPa) | Tensile strength (MPa) | HIC resistance | Remark |
|---|---|---|---|---|---|---|---|
| 1 | 29 | 635 | F + B | 599 | 672 | ○ | Example |
| 2 | 29 | 580 | F + B | 556 | 612 | ○ | |
| 3 | 21 | 620 | F + B | 601 | 681 | ○ | |
| 4 | 21 | 670 | F + B | 571 | 631 | ○ | |
| 5 | 32 | 655 | F + B | 587 | 652 | ○ | |
| 6 | 31 | 590 | F + B | 548 | 614 | ○ | |
| 7 | 30 | 645 | F + B | 579 | 644 | ○ | |
| 8 | 1.2 | 630 | F + B | 562 | 642 | ○ | |
| 9 | 22 | 640 | F + B | 589 | 665 | ○ | |
| 10 | 25 | 635 | F + B | 574 | 634 | ○ | |
| 11 | 1.8 | 670 | F + B | 605 | 689 | ○ | |
| 12 | 33 | 600 | F + B | 558 | 629 | ○ | |
| 13 | 2.0 | 650 | F + B | 539 | 616 | ○ | |
| 14 | 38 | 645 | F + B + MA | 461 | 541 | ○ | Comparative example |
| 15 | 33 | 630 | F + B + p | 574 | 634 | x | |
| 16 | 32 | 600 | F +P | 471 | 540 | x | |
| 17 | 32 | 630 | F +B +MA | 581 | 641 | x | |
| 18 | 0.2 | 600 | F +B +P | 487 | 565 | x | |
| 19 | 38 | 740 | F + B | 496 | 561 | x | |
| 20 | 36 | 460 | F +B +P | 501 | 582 | x | |
| 21 | 26 | 590 | F + B | 468 | 542 | x | |
| 22 | 31 | 620 | F +B +P | 495 | 568 | ○ | |
| 23 | 1.9 | 580 | F + B | 540 | 610 | x | |
| 24 | 24 | 650 | F + B | 461 | 534 | x | |
| 25 | 1.5 | 640 | F + B | 631 | 695 | x | |
| 26 | 1.5 | 655 | F + B | 598 | 666 | x | |

* Underline designates outside the range of the present invention.
* Microstructure F: ferrite, B: bainite, P: pearlite, MA: insular martensite AS shown in Table 5, all the steel plates of Nos. 1 to 13, which are the examples according to the second embodiment whose chemical compositions and manufacturing conditions are within the range of the present invention, have yield strength of 480 MPa or higher, tensile strength of 580 MPa or higher, and excellent HIC resistance. The steel sheets consist substantially of a two phase microstructure of ferrite and bainite, wherein are dispersed fine carbides having particle size smaller than 1.0 nm and containing Ti and Mo, and further containing Nb and/or V for some of the steel plates. Area percentage of bainite is from 10 to 80% for all the steel plates. Hardness of bainite is HV 300 or smaller, and the difference in hardness between ferrite and bainite is HV 70 or smaller.

The steel plates Nos. 14 to 20 have chemical compositions within the range of the second embodiment, but have manufacturing conditions outside the range of the second embodiment. As a result, these steel plates have insufficient strength and initiate cracks in HIC test because they do not have a two phase microstructure of ferrite and bainite and do not have dispersed precipitates of fine carbides. The steel plates Nos. 21 to 26 have chemical compositions outside the range of the second embodiment, thus generating coarse precipitates and having no dispersed precipitates containing Ti and Mo, resulting in insufficient strength or initiation of cracks in HIC test.

No specific difference in result is observed between induction heating furnace and the gas furnace.

Third Embodiment

In the second embodiment, the inventors of the present invention found that both HIC resistance and high strength are available even if a part or whole of Mo is substituted by W.

High strength steel plate for line pipe according to the third embodiment will be described in detail in the following.

First, precipitates dispersed in ferrite according to the third embodiment will be discussed.

In the steel plate according to the third embodiment, ferrite is strengthened by dispersed precipitates containing basically Mo, W, and Ti, or W and Ti in ferrite, and the difference in strength between ferrite and bainite is decreased, thus giving excellent HIC resistance. Since the precipitates are extremely fine, they do not give influence on HIC resistance. Mo, W, and Ti are the elements of forming carbides in steel, and strengthening by precipitating MoC, WC, and TiC is well known in the related art. In the third embodiment, however, strength increase is attained owing to fine precipitates of complex carbides containing basically Mo, W, and Ti, or W and Ti in steel by adding these elements. This is because the complex carbides containing basically Mo, W, and Ti, or W and Ti are stable and slowly grow rate so that extremely fine precipitates having particle size smaller than 10 nm are obtained.

When the complex carbides containing basically Mo, W, and Ti, or W and Ti are made only by Mo, W, Ti, and C, the combination is given at around 1:1 atom ratio of the C content to the sum of Mo, W, and Ti contents, which has very strong effect of strength increase. In the third embodiment, the inventors of the present invention found that the addition of Nb and/or V allows forming precipitates of complex carbides containing Mo, W, Ti, and Nb and/or V, thus giving the same precipitation strengthening as the above case.

Chemical composition of the high strength steel plate for line pipe according to the third embodiment is the same as that of the second embodiment except that a part or whole of Mo in the second embodiment is substituted by W within a range described below.

[Mo+W/2]: [Mo+W/2] is from 0.05 to 0.5%. Tungsten is an element having equivalent function as Mo, and thus can substitute a part or whole of Mo. W may be added by 0.05 to 0.5% as W/2 when adding no Mo. 0.05% or more of [Mo+W/2] allows forming fine complex precipitates with Ti while suppressing pearlite transformation during cooling after hot rolling, thus significantly contributing to increase in strength. If, however, [Mo+W/2] exceeds 0.5%, hardened phase such as martensite is formed to degrade HIC resistance. Therefore, [Mo+W/2] is specified to a range from 0.05 to 0.5%, preferably from 0.05 to 0.3%.

[C/(Mo+W+Ti)] as ratio of C content to the sum of Mo, W, and Ti contents as atom percentage is from 0.5 to 3. High strength attained in the third embodiment owes to precipitates (mainly carbides) containing Mo, W, and Ti. To effectively apply precipitation strengthening by complex precipitates, the relation between C content and contents of Mo, W, and Ti which are the elements forming carbide should be considered. By adding these elements at an adequate balance, thermally stable and extremely fine complex precipitates are formed. If [C/(Mo+W+Ti], expressed by content of atom percentage of elements, is less than 0.5 or more than 3, any one of elements is in excessive amount, thus forming hardened phase to degrade HIC resistance and toughness. Consequently, [C/(Mo+W+Ti)] is specified to a range from 0.5 to 3. The symbol of each element designates the content thereof expressed by atom percentage. If content expressed by mass percentage is applied, [(C/12.0)/(Mo/95.9+W/183.8+Ti/47.9)] is specified to a range from 0.5 to 3. If [C/(Mo+Ti)] is in a range from 0.7 to 2, further fine precipitates are obtained.

According to the third embodiment, one or both of 0.005 to 0.05% Nb and 0.005 to 0.10% V may be added to further improve strength of steel plate.

For the case that Nb and/or V is added, [C/(Mo+W+Ti+Nb+V)] as ratio of C content to the sum of Mo, W, Ti, Nb, and V contents is from 0.5 to 3. High strength attained in the third embodiment owes to precipitates containing Mo, W, and Ti. The complex precipitates (mainly carbides) also contain Nb and/or V. If [C/(Mo+W+Ti+Nb+V)], expressed by content of atom percentage of elements, is less than 0.5 or more than 3, any one of elements is in excessive amount, thus forming hardened phase to degrade HIC resistance and toughness. Consequently, [C/(Mo+W+Ti+Nb+V)] is specified to a range from 0.5 to 3. The symbol of each element designates the content thereof expressed by atom percentage. If content expressed by mass percentage is applied, [(C/12.0)/(Mo/95.9+W/183.8+Ti/47.9+Nb/92.9+V/50.9)] is specified to a range from 0.5 to 3, and more preferably the value thereof is from 0.7 to 2 to provide further fine precipitates.

The method for manufacturing a high strength steel plate for line pipe according to the third embodiment is the same as that of the second embodiment.

Example

The steels (steel Nos. A to N) having chemical compositions shown in Table 6 were continuously cast to slabs. Using the slabs, the steel plates (Nos. 1 to 26) having 18 and 26 mm in thickness were prepared.

The Ceq was calculated by the formula:

$$Ceq=C+Mn/6+(Cu+Ni)/15(Cr+Mo+V)/5+W/10$$

TABLE 6

(mass %)

| Steel No. | C | Si | Mn | P | S | W | Mo | Ti | Al | Mb | V |
|---|---|---|---|---|---|---|---|---|---|---|---|
| A | 0.049 | 0.09 | 1.38 | 0.005 | 0.0013 | 0.36 | | 0.032 | 0.032 | | |
| B | 0.072 | 0.22 | 1.28 | 0.008 | 0.0009 | 0.18 | 0.15 | 0.014 | 0.046 | 0.014 | |
| C | 0.065 | 0.19 | 1.54 | 0.007 | 0.0006 | 0.78 | | 0.024 | 0.026 | 0.019 | |
| D | 0.052 | 0.14 | 1.24 | 0.002 | 0.0008 | 0.41 | 0.05 | 0.021 | 0.036 | 0.022 | 0.025 |
| E | 0.049 | 0.18 | 1.20 | 0.010 | 0.0006 | 0.22 | | 0.012 | 0.032 | 0.042 | 0.047 |
| F | 0.045 | 0.26 | 1.25 | 0.008 | 0.0009 | 0.19 | | 0.022 | 0.031 | 0.039 | 0.051 |
| G | 0.052 | 0.25 | 1.25 | 0.005 | 0.0011 | 0.45 | | 0.018 | 0.031 | 0.030 | 0.015 |
| H | 0.026 | 0.22 | 1.06 | 0.009 | 0.0012 | 0.09 | | 0.008 | 0.025 | 0.016 | 0.031 |
| I | 0.052 | 0.18 | 1.51 | 0.007 | 0.0011 | 0.12 | | 0.003 | 0.037 | 0.012 | |
| J | 0.046 | 0.15 | 1.65 | 0.009 | 0.0009 | 0.03 | | 0.021 | 0.026 | 0.045 | 0.042 |
| K | 0.051 | 0.19 | 2.22 | 0.004 | 0.0008 | 0.31 | | 0.035 | 0.028 | 0.037 | 0.041 |
| L | 0.015 | 0.22 | 1.35 | 0.005 | 0.0008 | 0.48 | | 0.011 | 0.031 | 0.018 | |
| M | 0.112 | 0.14 | 1.45 | 0.01 | 0.0009 | 0.21 | | 0.023 | 0.029 | 0.039 | 0.120 |
| N | 0.049 | 0.24 | 1.25 | 0.006 | 0.0035 | 0.24 | | 0.015 | 0.036 | 0.069 | 0.041 |

(mass %)

| Steel No. | Cu | Ni | Cr | Ca | C/(Mo + Ti + Nb + V) | Ceq | Remark |
|---|---|---|---|---|---|---|---|
| A | | | | | 1.55 | 0.32 | Chemical |
| B | | | | | 2.01 | 0.33 | composition |
| C | | | | | 1.09 | 0.40 | within |
| D | | | | | 1.11 | 0.31 | the range |

TABLE 6-continued

| | | | | | | | |
|---|---|---|---|---|---|---|---|
| E | | | | 0.0021 | 1.45 | 0.28 | of the |
| F | | | | 0.0025 | 1.29 | 0.28 | invention |
| G | 0.14 | 0.22 | | 0.0037 | 1.26 | 0.33 | |
| H | | | 0.18 | 0.0009 | 1.51 | 0.25 | |
| I | | | | | 5.13 | 0.32 | Chemical |
| J | | | | | 2.00 | 0.33 | composition |
| K | | | | 0.0029 | 1.17 | 0.46 | outside |
| L | | | 0.21 | | 0.41 | 0.33 | the range |
| M | | | | 0.0071 | 2.12 | 0.40 | of the |
| N | 0.22 | 0.18 | | 0.0021 | 1.29 | 0.32 | invention |

* Underline designates outside the range of the present invention.

The steel plates, prepared by heating the slabs and hot rolling them, were immediately cooled by an accelerated cooling apparatus of water cooling type, and then were reheated by an induction heating furnace or a gas furnace. Both the accelerated cooling apparatus and the induction heating furnace were installed in the same line. The manufacturing conditions of the steel plates (Nos. 1 to 26) are given in Table 7.

Microstructure of thus prepared steel plates was observed using a optical microscope and a transmission electron microscope (TEM). Composition of precipitates in ferrite was analyzed by energy dispersive X-ray spectroscopy (EDX). Tensile properties and HIC resistance for each steel plate were measured. The results of measurements are also given in Table 7. Regarding tensile properties, tensile test was conducted using a total thickness specimen taken in the direction lateral to rolling direction to determine yield strength and tensile strength. Considering dispersion during manufacturing, the steel plate having yield strength of 480 MPa or higher and tensile strength of 580 MPa or higher was estimated as a high strength steel plate of API X65 or higher grade. As for HIC resistance, HIC test was given conforming to NACE Standard TM-02-84 with an immersion time of 96 hours, and the steel plate giving no crack was judged to have good HIC resistance and marked with ○, and the steel plate giving crack initiation was marked with x.

TABLE 7

| Steel plate No. | Steel No. | Plate thickness (mm) | Heating temperature (° C.) | Finishing temperature (° C.) | Cooling rate (° C./s) | Cooling stop temperature (° C.) | Reheating apparatus |
|---|---|---|---|---|---|---|---|
| 1 | A | 18 | 1200 | 840 | 36 | 450 | Induction heating furnace |
| 2 | B | 18 | 1200 | 790 | 33 | 420 | Induction heating furnace |
| 3 | C | 26 | 1200 | 900 | 22 | 500 | Induction heating furnace |
| 4 | D | 26 | 1100 | 800 | 21 | 490 | Induction heating furnace |
| 5 | E | 18 | 1200 | 850 | 30 | 510 | Induction heating furnace |
| 6 | E | 18 | 1200 | 770 | 30 | 500 | Induction heating furnace |
| 7 | E | 18 | 1200 | 870 | 35 | 410 | Induction heating furnace |
| 8 | E | 18 | 1200 | 900 | 32 | 480 | Gas-fired furnace |
| 9 | F | 26 | 1200 | 850 | 28 | 500 | Induction heating furnace |
| 10 | F | 26 | 1100 | 840 | 31 | 510 | Induction heating furnace |
| 11 | G | 18 | 1200 | 900 | 42 | 570 | Gas-fired furnace |
| 12 | G | 18 | 1200 | 850 | 44 | 450 | Induction heating furnace |
| 13 | H | 18 | 1200 | 880 | 41 | 500 | Gas-fired furnace |
| 14 | D | 18 | 950 | 820 | 33 | 500 | Induction heating furnace |
| 15 | D | 18 | 1150 | 700 | 32 | 520 | Induction heating furnace |
| 16 | D | 18 | 1200 | 850 | 1 | 480 | Induction heating furnace |
| 17 | D | 18 | 1200 | 840 | 38 | 280 | Induction heating furnace |
| 18 | D | 26 | 1200 | 870 | 19 | 450 | Gas-fired furnace |
| 19 | D | 26 | 1200 | 870 | 21 | 450 | Induction heating furnace |
| 20 | D | 26 | 1200 | 870 | 20 | 410 | Induction heating furnace |
| 21 | I | 18 | 1200 | 820 | 42 | 490 | Induction heating furnace |

TABLE 7-continued

| | | | | | | | |
|---|---|---|---|---|---|---|---|
| 22 | J | 18 | 1200 | 820 | 36 | 520 | Induction heating furnace |
| 23 | K | 18 | 1200 | 820 | 38 | 460 | Gas-fired furnace |
| 24 | L | 26 | 1200 | 850 | 22 | 500 | Induction heating furnace |
| 25 | M | 26 | 1200 | 850 | 21 | 490 | Gas-fired furnace |
| 26 | N | 26 | 1200 | 850 | 18 | 520 | Gas-fired furnace |

| Steel plate No. | Reheating rate (°/s) | Reheating temperature (° C.) | Micro-structure | Yield strength (MPa) | Tensile strength (MPa) | HIC resistance | Remark |
|---|---|---|---|---|---|---|---|
| 1 | 31 | 650 | F + B | 581 | 651 | ○ | Example |
| 2 | 24 | 590 | F + B | 549 | 618 | ○ | |
| 3 | 21 | 630 | F + B | 602 | 675 | ○ | |
| 4 | 22 | 650 | F + B | 567 | 629 | ○ | |
| 5 | 29 | 650 | F + B | 575 | 642 | ○ | |
| 6 | 31 | 580 | F + B | 531 | 602 | ○ | |
| 7 | 30 | 640 | F + B | 578 | 651 | ○ | |
| 8 | 1.5 | 650 | F + B | 570 | 644 | ○ | |
| 9 | 18 | 645 | F + B | 592 | 670 | ○ | |
| 10 | 21 | 645 | F + B | 569 | 641 | ○ | |
| 11 | 1.6 | 660 | F + B | 617 | 691 | ○ | |
| 12 | 28 | 590 | F + B | 564 | 631 | ○ | |
| 13 | 1.9 | 640 | F + B | 558 | 621 | ○ | |
| 14 | 35 | 650 | F + B | 471 | 551 | ○ | Comparative example |
| 15 | 33 | 640 | F + B | 558 | 625 | x | |
| 16 | 35 | 590 | F +P | 468 | 555 | x | |
| 17 | 38 | 640 | F +B +MA | 570 | 641 | x | |
| 18 | 0.3 | 600 | F +B +P | 490 | 562 | x | |
| 19 | 28 | 760 | F + B | 503 | 570 | x | |
| 20 | 26 | 480 | F +B +P | 521 | 590 | x | |
| 21 | 30 | 590 | F + B | 470 | 548 | x | |
| 22 | 31 | 620 | F +B +P | 501 | 565 | ○ | |
| 23 | 2.1 | 580 | F + B | 553 | 620 | x | |
| 24 | 24 | 650 | F + B | 458 | 528 | x | |
| 25 | 1.2 | 640 | F + B | 628 | 701 | x | |
| 26 | 1.3 | 655 | F + B | 584 | 652 | x | |

* Underline designates outside the range of the present invention.
* Microstructure F: ferrite, B: bainite, P: pearlite, MA: Insular martensite As shown in Table 7, all the steel plates of Nos. 1 to 13, which are the examples according to the third embodiment whose chemical compositions and manufacturing conditions are within the range of the present invention, have yield strength of 480 MPa or higher, tensile strength of 580 MPa or higher, and excellent HIC resistance. The steel sheets consist substantially of a two phase microstructure of ferrite and bainite, wherein are dispersed fine carbides having particle size smaller than 10 nm and containing Ti and W, and further containing Nb and/or V, and Mo for some of the steel plates.

The steel plates Nos. 14 to 20 have chemical compositions within the range of the third embodiment, but have manufacturing conditions outside the range of the third embodiment. As a result, these steel plates have insufficient strength and initiate cracks in HIC test because they do not have a two phase microstructure of ferrite and bainite and do not have dispersed precipitates of fine carbides. The steel plates Nos. 21 to 26 have chemical compositions outside the range of the third embodiment, thus generating coarse precipitates and having no dispersed precipitates containing Ti and W, resulting in insufficient strength or initiation of cracks in HIC test.

No specific difference in result is observed between induction heating furnace and the gas furnace.

Forth Embodiment

In the second and third embodiments, the inventors of the present invention found that both HIC resistance and high strength are available by adding two or more elements selected from the group consisting of Ti, Nb, and V, even if Mo and W are not added.

High strength steel plate for line pipe according to the forth embodiment will be described in detail in the following.

First, precipitates dispersed in ferrite according to the forth embodiment will be discussed.

In the steel plate according to the forth embodiment, ferrite is strengthened by dispersed precipitates containing two or more elements selected from the group consisting of Ti, Nb, and V, and the difference in strength between ferrite and bainite is decreased, thus giving excellent HIC resistance. Since the precipitates are extremely fine, they do not give influence on HIC resistance. Ti, Nb, and V are the elements of forming carbides in steel, and strengthening by carbides of the elements is well known in the related art. According to the related art, carbides are precipitated through transformation from austenite to ferrite during cooling or temperature holding after hot rolling, or from supersaturated ferrite. Carbides are also precipitated in bainite or martensite tempered after hot rolling and rapid cooling. On the other hand, in the forth embodiment, carbides are precipitated through transformation from bainite to ferrite during reheating. In this method, ferrite transformation proceeds very rapidly, and therefore extremely fine complex carbides are precipitated at the interface of transformation, giving stronger effect of strength increase compared with the ordinary method.

Complex carbides containing two or more elements selected from the group consisting of Ti, Nb, and V have a combination of C with Ti, Nb, and V at around 1:1 atom ratio of C content to the sum of Ti, Nb, and V contents. By putting [C/(Ti+Nb+V)] as ratio of C content to the sum of Ti, Nb, and V contents by atom percentage in a range from 0.5 to 3.0, fine complex carbides having particle size of 30 nm or smaller are precipitated. Compared with the second and third embodiments containing Mo and W, the forth embodiment gives coarse grain of precipitates so that precipitation strengthening is small. Nevertheless, the forth embodiment is able to increase strength up to API X70 grade.

It is preferable that the steel plate according to the forth embodiment consists substantially of a two phase microstructure of ferrite and bainite, and that area percentage of bainite is preferably 10% or more from the point of securing toughness, and preferably 80% or smaller from the point of HIC resistance, and more preferably 20 to 60%.

In the forth embodiment, the difference in hardness between bainite and ferrite is preferably HV 70 or smaller, more preferably HV 50 or smaller, and most preferably HV 35 or smaller. The upper limit of hardness of bainite is preferably HV 320. More preferably the hardness of bainite is HV 300 or smaller, and most preferably HV 280 or smaller.

Chemical composition of the steel plate for line pipe according to the forth embodiment will be described below. The unit expressed by % applied in the following description is mass percentage unless otherwise noted.

Carbon: C content is from 0.02 to 0.08%. Carbon is an element of contributing to precipitate strengthening as carbides. If, however, C content is less than 0.02%, sufficient strength cannot be attained, and, if C content exceeds 0.08%, toughness and HIC resistance degrade. Therefore, C content is specified to a range from 0.02 to 0.08%.

Silicon: Si content is from 0.01 to 0.5%. Silicon is added for deoxidation. If, however, Si content is less than 0.01%, the effect of deoxidation is insufficient, and, if Si content exceeds 0.5%, toughness and weldability degrade. Consequently, Si content is specified to a range from 0.01 to 0.5%.

Manganese: Mn content is from 0.5 to 1.8%. Manganese is added to increase strength and toughness. If, however, Mn content is less than 0.5%, the effect is not sufficient, and, if Mn content exceeds 1.8%, weldability and HIC resistance degrade. Thus, Mn content is specified to a range from 0.5 to 1.8%, and preferably from 0.5 to 1.5%.

Phosphorus: P content is 0.01% or less. Phosphorus is an inevitable impurity element that degrades weldability and HIC resistance. Therefore, the upper limit of P content is specified to 0.01%.

Sulfur: S content is 0.002% or less. Smaller content of S is preferred because S generally forms MnS inclusions in steel to degrade HIC resistance. If, however, S content is 0.002% or less, no problem is induced. Consequently, the upper limit of S content is specified to 0.002%.

Aluminum: Al content is 0.07% or less. Aluminum is added as a deoxidant. If, however, Al content exceeds 0.07%, cleanliness of steel degrades, and HIC resistance degrades. Consequently, Al content is specified to 0.07% or less, and preferably from 0.001 to 0.07%.

The steel plate according to the forth embodiment contains two or more elements selected from the group consisting of Ti, Nb, and V.

Titanium: Ti content is from 0.005 to 0.04%. Titanium is an important element in the forth embodiment. Addition of Ti to 0.005% or more allows forming fine complex carbides with Nb and/or V to significantly contribute to strength increase. If, however, Ti content exceeds 0.04%, toughness of welding heat-affected zone degrades. Therefore, Ti content is specified to a range from 0.0055 to 0.04%.

Niobium: Nb content is 0.005 to 0.05%. Niobium improves toughness by refining structure. Niobium forms fine complex carbides together with Ti and/or V to contribute to strength increase of ferrite. If, however, Nb content is below 0.005%, the effect cannot be attained, and, if Nb content exceeds 0.05%, toughness of welding heat-affected zone degrades. Consequently, Nb content is specified to a range from 0.005 to 0.05%.

Vanadium: V content is from 0.005 to 0.1%. Similar to Ti and Nb, V forms complex carbides together with Ti and/or Nb to contribute to strength increase of ferrite. If, however, V content is below 0.005%, the effect cannot be attained, and, if V content exceeds 0.1%, toughness of welding heat-affected zone degrades. Consequently, V content is specified to a range from 0.005 to 0.1%.

[C/(Ti+Nb+V)] as ratio of C content to the sum of Ti, Nb, and V contents is from 0.5 to 3. High strength attained in the forth embodiment owes to fine carbides containing at least two of Ti, Nb, and V. To effectively utilize precipitation strengthening by fine carbides, the relation between C content and contents of Ti, Nb, and V which are the elements forming carbide should be controlled. By adding these elements at an adequate, balance, thermally stable and extremely fine complex carbides are formed. If [C/(Ti+Nb+V)], expressed by content of atom percentage of elements, is less than 0.5 or more than 3, any one of elements is in excessive amount, thus forming hardened structure to degrade HIC resistance and toughness. Consequently, [C/(Ti+Nb+V)] is specified to a range from 0.5 to 3. The symbol of each element designates content expressed by atom percentage. If content expressed by mass percentage is applied, [(C/12.0)/(Ti/47.9+Nb/92.91+V/50.94)] is specified to a range from 0.5 to 3.

According to the forth embodiment, one or more element selected from the group consisting of 0.5% or less Cu, 0.5% or less Ni, 0.5% or less Cr, and 0.0005 to 0.005% Ca may be added to steel, to further improve strength and HIC resistance.

From the viewpoint of weldability, it is preferable to specify the upper limit of the Ceq which is defined by the following-formula depending on desired strength level. Favorable weldability is attained by specifying the Ceq to 0.28 or smaller for the case of 448 MPa or higher yield strength, and 0.32 or smaller for 482 MPa or higher yield strength.

$$Ceq=C+Mn/6+(Cu+Ni)/15+(Cr+Mo+V)/5$$

Regarding the steel plate according to the forth embodiment, there is no dependency of Ceq on plate thickness within a range from 10 to 30 mm in plate thickness. Thus, the design is applicable with the same Ceq value up to 30 mm in plate thickness.

Other than the above-described elements, balance is substantially Fe. The term "balance is substantially Fe" means that the steel containing inevitable impurities and other trace elements is within the scope of the second embodiment unless the effect of the forth embodiment is hindered.

The method for manufacturing a high strength steel plate for line pipe according to the forth embodiment is the same as that of the second embodiment or the third embodiment.

Example

The steels (steel Nos. A to N) having chemical compositions shown in Table 8 were continuously cast to slabs. Using the slabs, the steel plates (Nos. 1 to 27) having 18 and 26 mm in thickness were prepared.

TABLE 8

(mass %)

| Steel No. | C | Si | Mn | P | S | Ti | Al | Nb | V | Cu | Ni | Cr | Ca | C/(Mo + Ti + Nb + V) | Ceq | Remark |
|---|---|---|---|---|---|---|---|---|---|---|---|---|---|---|---|---|
| A | 0.041 | 0.22 | 1.38 | 0.009 | 0.0012 | 0.035 | 0.032 | 0.045 | | | | | | 2.81 | 0.27 | Chemical |
| B | 0.042 | 0.25 | 1.25 | 0.005 | 0.0008 | 0.025 | 0.046 | | 0.075 | | | | | 1.75 | 0.27 | composition |
| C | 0.048 | 0.26 | 1.54 | 0.008 | 0.0009 | | 0.026 | 0.045 | 0.048 | | | | | 2.80 | 0.31 | within |
| D | 0.049 | 0.21 | 1.24 | 0.010 | 0.0005 | 0.027 | 0.036 | 0.041 | 0.059 | | | | | 1.89 | 0.27 | the range |
| E | 0.071 | 0.18 | 1.29 | 0.002 | 0.0007 | 0.036 | 0.032 | 0.042 | 0.048 | | | | 0.0025 | 2.75 | 0.30 | of the |
| F | 0.045 | 0.22 | 1.25 | 0.007 | 0.0008 | 0.011 | 0.031 | 0.041 | 0.051 | | | | 0.0022 | 2.24 | 0.26 | invention |
| G | 0.036 | 0.22 | 1.25 | 0.008 | 0.0009 | 0.021 | 0.031 | 0.030 | 0.042 | 0.14 | 0.22 | | 0.0009 | 1.89 | 0.28 | |
| H | 0.031 | 0.15 | 1.74 | 0.005 | 0.0011 | 0.008 | 0.025 | 0.034 | 0.031 | | | 0.18 | 0.0032 | 2.26 | 0.36 | |
| I | 0.051 | 0.22 | 1.35 | 0.006 | 0.0009 | 0.002 | 0.037 | 0.035 | 0.036 | | | | | 3.77 | 0.28 | Chemical |
| J | 0.051 | 0.23 | 1.28 | 0.010 | 0.0011 | | 0.030 | | | | | | | | 0.26 | composition |
| K | 0.048 | 0.18 | 2.03 | 0.005 | 0.0010 | 0.034 | 0.028 | 0.042 | 0.051 | | | | 0.0022 | 1.85 | 0.40 | outside |
| L | 0.012 | 0.22 | 1.35 | 0.004 | 0.0008 | 0.028 | 0.031 | 0.045 | 0.075 | | 0.16 | 0.21 | | 0.39 | 0.28 | the range |
| M | 0.106 | 0.15 | 1.23 | 0.009 | 0.0013 | 0.012 | 0.028 | 0.038 | 0.036 | | | | 0.0068 | 06.46 | 0.32 | of the |
| N | 0.049 | 0.19 | 1.33 | 0.007 | 0.0029 | 0.015 | 0.032 | 0.031 | 0.041 | 0.23 | | | 0.0019 | 2.81 | 0.30 | invention |

* Underline designates outside the range of the present invention.

The steel plates, prepared by heating the slabs and hot rolling them, were immediately cooled by an accelerated cooling apparatus of water cooling type, and then were reheated by an induction heating furnace or a gas furnace. Both the accelerated cooling apparatus and the induction heating furnace were installed in the same line. The manufacturing conditions of the steel plates (Nos. 1 to 27) are given in Table 9.

Microstructure of thus prepared steel plates was observed using a optical microscope and a transmission electron microscope (TEM). In addition, area percentage of bainite was determined. Hardness of ferrite and of bainite was measured by a Vickers hardness tester with a load of 50 g to determine the difference in hardness between ferrite and bainite by averaging the values obtained from 30 points of measurement. Composition of precipitates in ferrite was analyzed by energy dispersive X-ray spectroscopy (EDX). Tensile properties and HIC resistance for each steel plate were measured. The results of measurements are also given in Table 9. Regarding tensile properties, tensile test was conducted using a total thickness specimen taken in the direction lateral to rolling direction to determine yield strength and tensile strength. Considering dispersion during manufacturing, the steel plate having yield strength of 480 MPa or higher and tensile strength of 580 MPa or higher was estimated as a high strength steel plate of API X65 or higher grade. As for HIC resistance, HIC test was given conforming to NACE Standard TM-02-84 with an immersion time of 96 hours, and the steel plate giving no crack was judged to have good HIC resistance and marked with ○, and the steel plate giving crack initiation was marked with x.

TABLE 9

| Steel plate No. | Steel No. | Sheet thickness (mm) | Heating temperature (° C.) | Finishing temperature (° C.) | Cooling rate (° C./s) | Cooling stop temperature (° C.) | Reheating apparatus |
|---|---|---|---|---|---|---|---|
| 1 | A | 18 | 1200 | 860 | 42 | 490 | Induction heating furnace |
| 2 | B | 18 | 1200 | 760 | 36 | 420 | Induction heating furnace |
| 3 | C | 26 | 1200 | 900 | 24 | 500 | Induction heating furnace |
| 4 | D | 26 | 1100 | 850 | 23 | 500 | Induction heating furnace |
| 5 | E | 18 | 1200 | 850 | 35 | 490 | Induction heating furnace |
| 6 | F | 18 | 1200 | 850 | 36 | 500 | Induction heating furnace |
| 7 | F | 18 | 1200 | 820 | 32 | 420 | Induction heating furnace |
| 8 | F | 18 | 1200 | 760 | 35 | 450 | Induction heating furnace |
| 9 | F | 18 | 1200 | 860 | 35 | 480 | Gas-fired furnace |
| 10 | G | 26 | 1200 | 850 | 26 | 540 | Induction heating furnace |
| 11 | G | 26 | 1100 | 840 | 27 | 500 | Induction heating furnace |
| 12 | H | 18 | 1200 | 920 | 21 | 540 | Induction heating furnace |
| 13 | H | 18 | 1200 | 850 | 18 | 470 | Gas-fired furnace |
| 14 | H | 18 | 960 | 900 | 20 | 510 | Gas-fired furnace |
| 15 | C | 18 | 1200 | 800 | 33 | 500 | Induction heating furnace |

TABLE 9-continued

| | | | | | | | |
|---|---|---|---|---|---|---|---|
| 16 | C | 18 | 1200 | 680 | 38 | 490 | Induction heating furnace |
| 17 | C | 18 | 1200 | 850 | 1 | 500 | Induction heating furnace |
| 18 | C | 18 | 1200 | 850 | 36 | 280 | Induction heating furnace |
| 19 | C | 26 | 1200 | 850 | 23 | 500 | Gas-fired furnace |
| 20 | C | 26 | 1200 | 850 | 21 | 480 | Induction heating furnace |
| 21 | C | 26 | 1200 | 850 | 23 | 400 | Induction heating furnace |
| 22 | I | 18 | 1200 | 820 | 45 | 490 | Induction heating furnace |
| 23 | J | 18 | 1200 | 820 | 38 | 520 | Induction heating furnace |
| 24 | K | 18 | 1200 | 820 | 40 | 450 | Gas-fired furnace |
| 25 | L | 26 | 1200 | 850 | 24 | 500 | Induction heating furnace |
| 26 | M | 26 | 1200 | 850 | 19 | 480 | Induction heating furnace |
| 27 | N | 26 | 1200 | 850 | 20 | 500 | Induction heating furnace |

| Steel plate No. | Reheating rate (°/s) | Reheating temperature (° C.) | Micro-structure | Yield strength (MPa) | Tensile strength (MPa) | HIC resistance | Remark |
|---|---|---|---|---|---|---|---|
| 1 | 22 | 635 | F + B | 561 | 641 | ○ | Example |
| 2 | 26 | 580 | F + B | 532 | 615 | ○ | |
| 3 | 18 | 640 | F + B | 538 | 602 | ○ | |
| 4 | 21 | 650 | F + B | 572 | 642 | ○ | |
| 5 | 28 | 640 | F + B | 592 | 672 | ○ | |
| 6 | 31 | 650 | F + B | 548 | 614 | ○ | |
| 7 | 29 | 580 | F + B | 529 | 594 | ○ | |
| 8 | 29 | 650 | F + B | 538 | 605 | ○ | |
| 9 | 1.8 | 640 | F + B | 549 | 615 | ○ | |
| 10 | 19 | 650 | F + B | 564 | 635 | ○ | |
| 11 | 18 | 630 | F + B | 544 | 613 | ○ | |
| 12 | 29 | 660 | F + B | 541 | 613 | ○ | |
| 13 | 2.0 | 590 | F + B | 528 | 591 | ○ | |
| 14 | 2.0 | 640 | F + B | 536 | 616 | ○ | Comparative |
| 15 | 29 | 650 | F + B | 460 | 531 | x | example |
| 16 | 26 | 630 | F + B | 562 | 629 | x | |
| 17 | 32 | 600 | F +P | 471 | 551 | x | |
| 18 | 28 | 640 | F +B +MA | 560 | 631 | x | |
| 19 | 0.3 | 650 | F +B +P | 491 | 561 | x | |
| 20 | 21 | 750 | F + B | 501 | 571 | ○ | |
| 21 | 19 | 450 | F +B +P | 511 | 585 | x | |
| 22 | 26 | 590 | F + B | 461 | 539 | x | |
| 23 | 29 | 630 | F + B | 450 | 530 | x | |
| 24 | 1.8 | 580 | F + B | 581 | 652 | x | |
| 25 | 21 | 640 | F + B | 452 | 519 | x | |
| 26 | 19 | 650 | F + B | 612 | 689 | x | |
| 27 | 20 | 650 | F + B | 568 | 639 | x | |

* Underline designates outside the range of the present invention.

* Microstructure F: ferrite, B: bainite, P: pearlite, MA: insular martensite

As shown in Table 9, all the steel plates of Nos. 1 to 14, which are the examples according to the forth embodiment whose chemical compositions and manufacturing conditions are within the range of the present invention, have yield strength of 480 MPa or higher, tensile strength of 580 MPa or higher, and excellent HIC resistance. The steel sheets consist substantially of a two phase microstructure of ferrite and bainite, wherein are dispersed fine complex carbides having particle size smaller than 30 nm and containing two or more elements selected from the group consisting of Ti, Nb, and V. Area percentage of bainite is within a range from 10 to 80% for all the steel plates. Hardness of bainite is HV 300 or smaller, and the difference in hardness between ferrite and bainite is Fly 70 or smaller.

The steel plates Nos. 15 to 21 have chemical compositions within the range of the forth embodiment, but have manufacturing conditions outside the range of the forth embodiment. As a result, these steel plates have insufficient strength and initiate cracks in HIC test because they do not have a two phase microstructure of ferrite and bainite and do not have dispersed precipitates of fine carbides. The steel plates Nos. 22 to 27 have chemical compositions outside the range of the forth embodiment, thus generating coarse precipitates and having no dispersed precipitates containing two or more elements selected from the group consisting of Ti, Nb, and V, resulting in insufficient strength or initiation of cracks in HIC test.

No specific difference in result is observed between induction heating furnace and the gas furnace.

What is claimed is:

1. A method for manufacturing a high strength steel plate having a yield strength of 448 MPa or higher, comprising the steps of:

hot rolling, under the conditions of a heating temperature of 1000 to 1300° C. and of a finishing temperature of 750° C. or higher, a steel slab consisting essentially of 0.02 to 0.08% C, 0.01 to 0.5% Si, 0.5 to 1.8% Mn, 0.01% or less P, 0.002% or less S, 0.05 to 0.5% Mo, 0.005 to 0.04% Ti, and 0.07% or less Al, by mass, optionally containing one or both of 0.005 to 0.05 mass % Nb and 0.005 to 0.1 mass % V, optionally containing at least one element selected from the group consisting of 0.5 mass % or less Cu, 0.5 mass % or less Ni, 0.5 mass % or less Cr and 0.0005 to 0.005 mass % Ca, and a balance of Fe, wherein [C/(Mo+Ti)] as a ratio of C content to the sum of Mo and Ti contents by atom percentage is 0.5 to 3;

applying an accelerated cooling to the hot rolled steel plate to a cooling stop temperature of 300 to 600° C. at a cooling rate of 5° C./s or higher; and reheating the steel plate immediately after cooling thereof to a temperature of 550 to 700° C. at a heating rate of 0.5° C./s or higher, the steel plate having substantially a two phase microstructure of ferrite and bainite, the ferrite containing precipitates of complex carbides having a particle size of 10 nm or smaller and containing Ti and Mo.

2. The method for manufacturing a high strength steel plate as in claim 1, wherein the steel plate is heated during the step of reheating from the cooling stop temperature to a temperature which is 50° C. or higher thereabove.

3. A method for manufacturing a high strength steel plate having a yield strength of 448 MPa or higher, comprising the steps of:

hot rolling, under the conditions of a heating temperature of 1050 to 1250° C. and of a finishing temperature of 750° C. or higher, a steel slab consisting essentially of 0.02 to 0.08% C, 0.01 to 0.5% Si, 0.5 to 1.8% Mn, 0.01% or less P, 0.002% or less S, 0.05 to 0.5% Mo, 0.005 to 0.04% Ti, and 0.07% or less Al, by mass, optionally containing one or both of 0.005 to 0.05 mass % Nb and 0.005 to 0.1 mass % V, optionally containing at least one element selected from the group consisting of 0.5 mass % or less Cu, 0.5 mass % or less Ni, 0.5 mass % or less Cr and 0.0005 to 0.005 mass % Ca, and a balance of Fe, wherein [C/(Mo+Ti)] as a ratio of C content to the sum of Mo and Ti contents by atom percentage is 0.5 to 3;

forming a two phase microstructure of untransformed austenite and bainite by an accelerated cooling to the hot rolled steel plate to a cooling stop temperature of 300 to 600° C. at a cooling rate of 5° C./s or higher; and forming a two phase structure of ferrite containing dispersed precipitates and tempered bainite by reheating the steel plate immediately after cooling thereof to a temperature of 550 to 700° C., heating thereof by 50° C. or more, at a heating rate of 0.5° C./s or higher, the steel plate having substantially a two phase microstructure of ferrite and bainite, the ferrite containing precipitates of complex carbides having a particle size of 10 nm or smaller and containing Ti and Mo.

4. A method for manufacturing a high strength steel plate having a yield strength of 448 MPa or higher, comprising the steps of:

hot rolling, under the conditions of a heating temperature of 1000 to 1300° C. and of a finishing temperature of 750° C. or higher, a steel slab consisting essentially of 0.02 to 0.08% C, 0.01 to 0.5% Si, 0.5 to 1.8% Mn, 0.01% or less P, 0.002% or less S, 0.05 to 0.5% (Mo+W/2), 0.005 to 0.04% Ti, and 0.07% or less Al, by mass, optionally containing one or both of 0.005 to 0.05 mass % Nb and 0.005 to 0.1 mass % V, optionally containing at least one element selected from the group consisting of 0.5 mass % or less Cu, 0.5 mass % or less Ni, 0.5 mass % or less Cr and 0.0005 to 0.005 mass % Ca, and a balance of Fe, wherein [C/(Mo+W+Ti)] as a ratio of C content to the sum of Mo, W and Ti contents by atom percentage is 0.5 to 3;

applying an accelerated cooling to the hot rolled steel plate to a cooling stop temperature of 300 to 600° C. at a cooling rate of 5° C./s or higher; and reheating the steel plate immediately after cooling thereof to a temperature of 550 to 700° C. at a heating rate of 0.5° C./s or higher, the steel plate having substantially a two phase microstructure of ferrite and bainite, the ferrite containing precipitates of complex carbides having a particle size of 10 nm or smaller and containing Ti and Mo.

5. A method for manufacturing a high strength steel plate having a yield strength of 448 MPa or higher, comprising the steps of:

hot rolling, under the conditions of a heating temperature of 1000 to 1300° C. and of a finishing temperature of 750° C. or higher, a steel slab consisting essentially of 0.02 to 0.08% C, 0.01 to 0.5% Si, 0.5 to 1.8% Mn, 0.01% or less P, 0.002% or less S, 0.05 to 0.5% Mo, 0.005 to 0.04% Ti, and 0.07% or less Al, 0.005 to 0.05% Nb and/or 0.005 to 0.1% V, by mass, optionally containing at least one element selected from the group consisting of 0.5 mass % or less Cu, 0.5 mass % or less Ni, 0.5 mass % or less Cr and 0.0005 to 0.005 mass Ca, and a balance of Fe, wherein [C/(Mo+Ti+Nb+V)] as a ratio of C content to the sum of Mo, Ti, Nb, and V contents by atom percentage is 0.5 to 3;

applying an accelerated cooling to the hot rolled steel plate to the cooling stop temperature of 300 to 600° C. at a cooling rate of 5° C./s or higher; and reheating the steel plate immediately after cooling thereof to a temperature of 550 to 700° C. at a heating rate of 0.5° C./s or higher, the steel plate having substantially a two phase microstructure of ferrite and bainite, and the ferrite containing precipitates of complex carbides having a particle size of 10 nm or smaller, and containing Ti and Mo, and Nb and/or V.

6. A method for manufacturing a high strength steel plate having a yield strength of 448 MPa or higher, comprising the steps of:

hot rolling, under the conditions of a heating temperature of 1000 to 1300° C. and of a finishing temperature of 750° C. or higher, a steel slab consisting essentially of 0.02 to 0.08% C, 0.01 to 0.5% Si, 0.5 to 1.8% Mn, 0.01% or less P, 0.002% or less S, 0.05 to 0.5% Mo, 0.05 to 0.5% (Mo+W/2), 0.005 to 0.04% Ti, and 0.07% or less Al, 0.005 to 0.05% Nb and/or 0.005 to 0.1% V, by mass, optionally containing at least one element selected from the group consisting of 0.5 mass % or less Cu, 0.5 mass % or less Ni, 0.5 mass % or less Cr and 0.0005 to 0.005 mass % Ca, and a balance of Fe, wherein [C/(Mo+W+Ti+Nb+V)] as a ratio of C content to the sum of Mo, W, Ti, Nb, and V contents by atom percentage is 0.5 to 3;

applying an accelerated cooling to the hot rolled steel plate to the cooling stop temperature of 300 to 600° C. at a cooling rate of 5° C./s or higher; and reheating the steel plate immediately after cooling thereof to a temperature of 550 to 700° C. at a heating rate of 0.5°

C./s or higher, and having substantially a two phase microstructure of ferrite and bainite, the ferrite containing precipitates of complex carbides having a particle size of 10 nm or smaller and containing Ti, Mo, W, and Nb and/or V, or Ti, W, and Nb and/or V.

7. A method for manufacturing a high strength steel plate having a yield strength of 448 MPa or higher, comprising the steps of:

hot rolling, under the conditions of a heating temperature of 1000 to 1300° C. and of a finishing temperature of 750° C. or higher, a steel slab consisting essentially of 0.02 to 0.08% C, 0.01 to 0.5% Si, 0.5 to 1.8% Mn, 0.01% or less P, 0.002% or less S, 0.07% or less Al, by mass, at least two elements selected from the group consisting of 0.005 to 0.04% Ti, 0.005 to 0.05% Nb, and 0.005 to 0.1% V, and a balance of substantially Fe, wherein [C/(Ti+Nb+V)] as a ratio of C content to the sum of Ti, Nb, and V contents by atom percentage being 0.5 to 3;

applying an accelerated cooling to the hot rolled steel plate to a cooling stop temperature of 300 to 600° C. at a cooling rate of 5° C./s or higher; and reheating the steel plate immediately after cooling thereof to a temperature of 550 to 700° C. at a heating rate of 0.5° C./s or higher, the steel sheet having substantially a two phase microstructure of ferrite and bainite, the ferrite containing precipitates of complex carbides having a particle size of 30 nm or smaller and containing at least two elements selected from the group consisting of Ti, Nb, and V.

8. The method for manufacturing a high strength steel plate having a yield strength of 448 MPa or higher as in claim 1, wherein the step of reheating the steel plate immediately after cooling thereof to the temperature of 550 to 700° C. at a heating rate of 0.5° C./s or higher is carried out in an induction heating apparatus located in the same line containing a rolling mill and a cooling apparatus.

* * * * *

UNITED STATES PATENT AND TRADEMARK OFFICE

CERTIFICATE OF CORRECTION

PATENT NO. : 8,147,626 B2
APPLICATION NO. : 13/053879
DATED : April 3, 2012
INVENTOR(S) : Ishikawa et al.

It is certified that error appears in the above-identified patent and that said Letters Patent is hereby corrected as shown below:

Column 38, claim 5, line 33, after the word “mass” insert --%--.

Signed and Sealed this
Eleventh Day of December, 2012

David J. Kappos

David J. Kappos
*Director of the United States Patent and Trademark Office*